US007175262B2

(12) United States Patent
Furuhata

(10) Patent No.: US 7,175,262 B2
(45) Date of Patent: Feb. 13, 2007

(54) LIQUID-JET HEAD, METHOD OF MANUFACTURING THE SAME AND LIQUID-JET APPARATUS

(75) Inventor: Yutaka Furuhata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 309 days.

(21) Appl. No.: 10/859,362

(22) Filed: Jun. 3, 2004

(65) Prior Publication Data

US 2005/0012785 A1 Jan. 20, 2005

Related U.S. Application Data

(63) Continuation-in-part of application No. 10/390,149, filed on Mar. 18, 2003, now abandoned.

(30) Foreign Application Priority Data

Mar. 18, 2002 (JP) ..... 2002-074099
Mar. 17, 2003 (JP) ..... 2003-072088
Jun. 4, 2003 (JP) ..... 2003-159487

(51) Int. Cl.
*B41J 2/045* (2006.01)

(52) U.S. Cl. ..... 347/68

(58) Field of Classification Search ..... 347/68–71
See application file for complete search history.

(56) References Cited

U.S. PATENT DOCUMENTS

2004/0085410 A1* 5/2004 Miyata ..... 347/68

FOREIGN PATENT DOCUMENTS

JP 05042674 A 2/1993
JP 5-220956 A 8/1993
JP 05286131 A 11/1993
JP 06106724 A 4/1994
JP 7-256881 A 10/1995
JP 08244237 A 9/1996
JP 09234864 A 9/1997

(Continued)

*Primary Examiner*—K. Feggins
(74) *Attorney, Agent, or Firm*—Sughrue Mion, PLLC

(57) ABSTRACT

A liquid-jet head, a manufacturing method thereof and a liquid-jet apparatus are provided, the liquid-jet head capable of preventing damage to a vibration plate, easily and surely preventing damage to a piezoelectric element attributable to an external environment, simplifying a manufacturing process and improving a withstand voltage of the piezoelectric element. In the liquid-jet head including a passage-forming substrate 10 in which a pressure generating chamber 12 communicating with a nozzle orifice 21 is defined; and a piezoelectric element 300 which is constituted of a lower electrode 60, a piezoelectric layer 70 and an upper electrode 80 and is provided on the passage-forming substrate 10 with vibration plates 50 and 60 interposed therebetween, the piezoelectric element 300 is made of a thin film directly formed on the vibration plates 50 and 60 by deposition and a lithography method without an adhesive agent interposed therebetween; a junction plate 30 is joined onto a draw-out wiring 90 drawn out of the piezoelectric element 300 on the piezoelectric element 300-facing side of the passage-forming substrate 10 with an insulating adhesive agent 122 interposed therebetween; only a side face of the piezoelectric element 300 is covered with an adhesion layer 121 made of an adhesive agent 122 joining the junction plate 30 so as not to expose at least the piezoelectric layer 70; and thus the piezoelectric element 300 is sealed.

20 Claims, 15 Drawing Sheets

FOREIGN PATENT DOCUMENTS

| | | | |
|---|---|---|---|
| JP | 11-157075 | A | 6/1999 |
| JP | 11-235818 | A | 8/1999 |
| JP | 11-291493 | A | 10/1999 |
| JP | 2000-246897 | A | 9/2000 |
| JP | 2002-160366 | A | 6/2002 |

* cited by examiner

LIQUID-JET HEAD, METHOD OF MANUFACTURING THE SAME AND LIQUID-JET APPARATUS

This is a Continuation-In-Part of application Ser. No. 10/390,149, filed Mar. 18, 2003 now abandoned and incorporated herein by reference.

BACKGROUND OF THE INVENTION

1. Field of the Invention

The present invention relates to a liquid-jet head which ejects jets of liquid, a manufacturing method thereof and a liquid-jet apparatus. More particularly, the present invention relates to an ink-set recording head which ejects ink droplets by displacement of piezoelectric elements formed on surfaces of vibration plates partially constituting pressure generating chambers communicating with nozzle orifices ejecting ink droplets, to a manufacturing method thereof and to an ink-jet recording apparatus.

2. Description of the Related Art

In an ink-jet recording head, in which pressure generating chambers that communicate with nozzle orifices ejecting ink droplets are partially constituted of vibration plates, these vibration plates are deformed by piezoelectric elements to pressurize ink in the pressure generating chambers, and the ink droplets are ejected from the nozzle orifices, two types of recording heads are put into practical use. One is a recording head using piezoelectric actuators of a longitudinal vibration mode, which expand and contract in an axis direction of the piezoelectric elements, and the other is a recording head using piezoelectric actuators of a flexural vibration mode.

In the former one, a volume of each pressure generating chamber can be changed by abutting an end surface of the piezoelectric element against the vibration plate, and manufacturing of a head suitable to high density printing is enabled. On the contrary, there is required a difficult process of cutting and dividing the piezoelectric element in a comb tooth shape in accordance with an array pitch of the nozzle orifices and work of positioning and fixing the cut and divided piezoelectric elements to the pressure generating chambers. Thus, there is a problem of a complex manufacturing process.

On the other hand, as the latter ink-jet recording head, in Japanese Patent Laid-Open No. Hei 5 (1993)-42674, proposed is one, in which a vibration plate is laminated on a passage-forming substrate with pressure generating chambers provided thereon by adhesion or diffused junction and piezoelectric elements are adhered onto this vibration plate with an adhesive agent applied therebetween.

The adhesion of the piezoelectric elements and the vibration plate with the adhesive agent applied therebetween leads to a problem that, because of insufficient interfacial bonding between the piezoelectric elements and the adhesive agent, the piezoelectric elements are likely to be peeled off from the vibration plate by repetitive deformation of the piezoelectric elements. In order to solve the above problem, in Japanese Patent Laid-Open No. Hei 5 (1993)-42674, a constitution is disclosed as a conventional example, in which, in order to make the peeling off of the piezoelectric elements from the vibration plate unlikely to occur, an amount of the adhesive agent used for the adhesion of the piezoelectric elements and the vibration plate is enlarged and the adhesive agent is largely raised on a side of the piezoelectric element.

In Japanese Patent Laid-Open No. Hei 5 (1993)-42674, with the conventional constitution in which the adhesive agent is largely raised on the side of the piezoelectric element, there is a problem as below. Specifically, use of an insulating adhesive agent deteriorates conductivity, thus causing a need to increase a voltage applied to the piezoelectric element and inhibiting durability of the piezoelectric element, and use of a conductive adhesive agent is unsuitable for adhesion of the piezoelectric element because of its weak adhesion strength. In order to solve the above problem, a thin film of a coupling agent is formed on a vibration plate and the piezoelectric element is adhered to the vibration plate by injecting the insulating adhesive agent into a gap between the coupling agent and the piezoelectric element or therearound.

Moreover, in Japanese Patent Laid-Open No. Hei 9 (1997)-234864, there is proposed an ink-set recording head, in which piezoelectric elements are adhered onto a vibration plate with an adhesive agent interposed therebetween.

In this gazette, disclosed is a constitution, in which a reinforcement plate made of a metal plate with high rigidity is joined or adhered onto a passage-forming substrate, in which pressure generating chambers are formed, and a piezoelectric element is adhered onto this reinforcement plate with an adhesive agent interposed therebetween so that one of the electrodes of the piezoelectric element (a lower electrode) is electrically conducted to the reinforcement plate. In the disclosed invention, in order that the piezoelectric element is joined in such a way that one of the electrodes thereof directly contacts the reinforcement plate, the piezoelectric element and the reinforcement plate are adhered to each other by providing an adhesive agent in a square portion defined by a boundary between a side face of the piezoelectric element and the reinforcement plate.

Furthermore, in Japanese Patent Laid-Open No. Hei 6 (1994)-106724, there is proposed a constitution, in which a piezoelectric element is adhered onto a vibration plate with an adhesive agent interposed therebetween.

In this gazette, disclosed is a constitution, in which a vibration plate is joined onto a passage-forming substrate with an epoxy adhesive interposed therebetween, a piezoelectric element is joined onto this vibration plate with an epoxy adhesive interposed therebetween and a FPC is joined onto the piezoelectric element with a conductive adhesive agent interposed therebetween. When the conductive adhesive agent used in joining the piezoelectric element and the FPC protrudes over a side face of the piezoelectric element, both electrodes of the piezoelectric element are short-circuited. So as not to allow the short-circuiting to occur, the epoxy adhesive, which is used for the adhesion of the passage-forming substrate and the vibration plate and the adhesion of the vibration plate and the piezoelectric element, is made to protrude over the side faces of the piezoelectric element and the vibration plate to cover the both thereof with its surface tension.

There is a method in which the piezoelectric elements are fabricated and installed on the vibration plate by a relatively simple process of adhering a green sheet as a piezoelectric material while making a shape of the green sheet fit to that of the pressure generating chambers, and sintering the green sheet. However, with the constitution of adhering the piezoelectric elements on the vibration plate, a certain area of the vibration plate is required due to use of the flexural vibration, thus there is a problem that a high density array of the piezoelectric elements is difficult.

Meanwhile, in order to solve such a disadvantage of the latter recording head, as described in Japanese Patent Laid- Open No. Hei 5 (1993)-286131, a recording head is proposed, in which an even piezoelectric material layer is formed over the entire surface of a vibration plate by a deposition technology, the piezoelectric material layer is cut and divided into a shape corresponding to that of pressure generating chambers by a lithography method, and piezoelectric elements are formed so as to be independent of each pressure generating chamber.

The recording head described above has the following advantage. The work of adhering the piezoelectric elements to the vibration plate is eliminated, and the piezoelectric elements can be fabricated and installed by the lithography method, which is a precise and simple method. In addition, a thickness of each piezoelectric element can be thinned to enable a high-speed drive.

Moreover, in general, a sealing plate which has a piezoelectric element holding portion and seals the piezoelectric element is joined onto the piezoelectric element-facing surface of a passage-forming substrate on which pressure generating chambers are formed. By hermetically sealing this piezoelectric element holding portion with inert-gas and the like, damage to the piezoelectric elements attributable to an external environment is prevented.

However, in a miniaturized and high-density ink-jet recording head, since a wide head area cannot be secured, there is a problem as below. Specifically, a sealing hole which is for filling and hermetically sealing the piezoelectric element holding portion with inert-gas and the like, and through which the piezoelectric element holding portion provided on the sealing plate communicates with the outside becomes small, and thus it is difficult to completely hermetically seal the piezoelectric element holding portion.

Moreover, in the high-density ink-jet recording head, in order to thin the thickness of the piezoelectric element, a gap between the upper and lower electrodes is narrowed. Thus, there is a problem that a surface discharge occurs in a portion of an end surface of the piezoelectric element where the electrodes are exposed, and so a withstand voltage of the piezoelectric element is lowered.

Furthermore, in order to dispose piezoelectric elements and nozzle orifices in high density, there is a constitution in which a vibration plate is formed on a passage-forming substrate not by use of an adhesive agent but by deposition, thus obtaining a thin film. However, there is a problem that, in a square portion defined by a boundary between a side face of the piezoelectric element and the vibration plate, a crack is likely to occur in the vibration plate, ink in the pressure generating chambers flows towards the piezoelectric element via the crack and thus the piezoelectric element is damaged.

Note that, needless to say, such problems as described above similarly exist not only in the ink-jet recording head ejecting ink but also in another liquid-jet head ejecting a liquid other than ink.

SUMMARY OF THE INVENTION

In consideration of the circumstances as described above, the object of the present invention is to provide a liquid-jet head, a manufacturing method thereof and a liquid-jet apparatus, the liquid-jet head being capable of preventing damage to a vibration plate, easily and surely preventing damage of a piezoelectric element attributable to an external environment, achieving a simplified manufacturing process thereof and improving a withstand voltage of the piezoelectric elements.

A first aspect of the present invention to solve the above-mentioned problems is a liquid-jet head, characterized in that the liquid-jet head includes a passage-forming substrate in which a pressure generating chamber communicating with a nozzle orifice is defined, and a piezoelectric element which is made of a lower electrode, a piezoelectric layer and an upper electrode and is provided on the passage-forming substrate with a vibration plate interposed therebetween. The liquid-jet head is also characterized in that the piezoelectric element is made of a thin film directly formed on the vibration plate without an adhesive agent interposed therebetween but by deposition and a lithography method, and on the piezoelectric element-facing side of the passage-forming substrate, a junction plate is joined onto a draw-out wiring drawn out of the piezoelectric element with an insulating adhesive agent interposed therebetween, and only a side face of the piezoelectric element is covered with an adhesive layer made of an adhesive agent joining the junction plate so as not to expose at least the piezoelectric layer.

In the first aspect, at least the piezoelectric layer is covered with the adhesion layer so as not to be exposed, thus enabling the damage to the piezoelectric element attributable to the external environment to be easily and surely prevented and enabling the withstand voltage of the piezoelectric element to be improved. Moreover, the adhesive agent used in joining the passage-forming substrate and the junction plate together is used for the adhesion layer covering the piezoelectric layer, thus enabling the manufacturing process to be simplified. Furthermore, the occurrence of a crack in the vibration plate corresponding to a square portion defined by a boundary between the side face of the piezoelectric element and the vibration plate is prevented, and even if the crack occurs, the crack is sealed by the adhesion layer. Thus, it is possible to surely prevent damage to the piezoelectric element attributable to liquid from the pressure generating chamber.

A second aspect of the present invention is the liquid-jet head according to the first aspect, characterized in that the adhesion layer is formed by surface tension in the square portion defined by the boundary between the side face of the piezoelectric element and the vibration plate.

In the second aspect, the adhesion layer is formed across the square portion by surface tension of the adhesive agent, thus enabling the side face of the piezoelectric layer to be covered easily and surely.

A third aspect of the present invention is the liquid-jet head according to any one of the first and second aspects, characterized in that the adhesion layer is also provided on a side face of the upper electrode.

In the third aspect, the side face of the upper electrode is also covered by the adhesion layer. Thus, it is possible to surely prevent the damage to the piezoelectric element attributable to a surface discharge and an external environment.

A fourth aspect of the present invention is the liquid-jet head according to any one of the first to third aspects, characterized in that gas permeability of the adhesive agent is $1\times10^{-3}$ Pa·m$^3$/sec or less.

In the fourth aspect, an adhesive layer using an adhesive agent with a predetermined gas permeability is formed. Thus, it is possible to surely prevent the damage to the piezoelectric element attributable to the external environment.

A fifth aspect of the present invention is the liquid-jet head according to any one of the first to fourth aspects, characterized in that the adhesive agent is a thermosetting adhesive agent.

In the fifth aspect, by use of the thermosetting adhesive agent, the side face of the piezoelectric element is easily and surely covered therewith.

A sixth aspect of the present invention is the liquid-jet head according to any one of the first to fifth aspects, characterized in that the draw-out wiring is made of a part of the piezoelectric element.

In the sixth aspect, it is possible to allow the adhesive agent to run along the side face of the piezoelectric element sandwiched between the passage-forming substrate and the junction plate.

A seventh aspect of the present invention is the liquid-jet head according to any one of the first to sixth aspects, characterized in that the draw-out wiring is a lead electrode extended from the upper electrode to the passage-forming substrate.

In the seventh aspect, it is possible to allow the adhesive agent to run along a side face of the lead electrode sandwiched between the passage-forming substrate and the junction plate.

An eighth aspect of the present invention is the liquid-jet head according to any one of the first to seventh aspects, characterized in that the vibration plate is directly formed on the passage-forming substrate without an adhesive agent interposed therebetween.

In the eighth aspect, the direct formation of the vibration plate on the passage-forming substrate makes it possible to prevent damage to the vibration plate in joining the vibration plate to the passage-forming substrate and also prevent the manufacturing process from being complicated.

A ninth aspect of the present invention is the liquid-jet head according to any one of the first to eighth aspects, characterized in that the vibration plate includes the lower electrode.

In the ninth aspect, a volume of each pressure generating chamber can be surely changed by a deformation of the piezoelectric element and the vibration plate can be reinforced by the lower electrode. Thus, it is possible to prevent damage to the vibration plate due to the deformation of the piezoelectric element.

A tenth aspect of the present invention is the liquid-jet head according to any one of the first to ninth aspects, characterized in that the pressure generating chambers are formed on a single crystal silicon substrate by anisotropic etching.

In the tenth aspect, a liquid-jet head having high-density nozzle orifices can be manufactured relatively easily in large quantities.

An eleventh aspect of the present invention is the liquid-jet head according to any one of the first to tenth aspects, characterized in that a plurality of the draw-out wirings are provided in parallel and extended to a region not facing the pressure generating chambers on the passage-forming substrate, each of the draw-out wirings having a side face continuing to a side face of the piezoelectric element, and the liquid-jet head includes an adhesion region where the junction plate is joined while intersecting with and straddling at least a part of the plurality of draw-out wirings provided in parallel.

In the eleventh aspect, as the adhesive agent covering the side face of the piezoelectric element, the adhesive agent used in joining the junction plate and the passage-forming substrate is used. Moreover, a side face of a piezoeleotric layer is covered with the adhesive agent by allowing the adhesive agent to run along the side face of the draw-out wiring. Thus, it is possible to easily and surely cover the side face of the piezoelectric layer with the adhesive agent. Moreover, the manufacturing process thereof can be simplified.

A twelfth aspect of the present invention is the liquid-jet head according to any one of the first to eleventh aspects, characterized in that the side face-of the draw-out wiring is covered with the adhesion layer.

In the twelfth aspect, by covering the side face of the draw-out wiring with the adhesion layer, it is possible to surely perform hermetical sealing of a piezoelectric element holding portion of the junction plate.

A thirteenth aspect of the present invention is a liquid-jet apparatus, characterized in that the liquid-jet apparatus includes the liquid-jet head according to any one of the first to twelfth aspects.

In the thirteenth aspect, it is possible to realize a liquid-jet apparatus in which durability and reliability are improved while preventing damage to the head.

A fourteenth aspect of the present invention is a method of manufacturing a liquid-jet head, characterized in that the liquid-jet head includes a passage-forming substrate in which a pressure generating chamber communicating with a nozzle orifice ejecting a liquid droplet is defined, a piezoelectric element which is made of a lower electrode, a piezoelectric layer and an upper electrode and is a thin film formed on a vibration plate provided on one face of the passage-forming substrate without an adhesive agent interposed therebetween but by deposition and a lithography method, and a junction plate joined onto the piezoelectric element-facing side of the passage-forming substrate. The method of manufacturing the liquid-jet head is also characterized in steps of allowing the junction plate to abut on the passage-forming substrate and on a draw-out wiring drawn out of the piezoelectric element with an adhesive agent interposed therebetween, covering the side face of the piezoelectric element with the adhesive agent so as not to expose at least the piezoelectric layer by allowing the adhesive agent to run along a side face of the draw-out wiring by a surface tension of the adhesive agent, and joining the passage-forming substrate and the junction plate.

In the fourteenth aspect, the side face of the piezoelectric layer is covered with the adhesive agent used in joining the junction plates so that the side face of the piezoelectric layer is not exposed. Thus, the manufacturing process can be simplified. In addition, since the piezoelectric element is surely covered with the adhesive agent, the destruction thereof attributable to a surface discharge and an external environment can be prevented. Moreover, cracking is prevented from occurring in the area of vibration plate corresponding to a square portion defined by a boundary between the side face of the piezoelectric element and the vibration plate, and even if a crack occurs, the crack is sealed by the adhesion layer, Thus, it is possible to surely prevent the piezoelectric element from being damaged by a liquid from the pressure generating chambers.

A fifteenth aspect of the present invention is the method of manufacturing a liquid-jet head according to the fourteenth aspect, characterized in that the adhesive agent is a thermosetting adhesive agent.

In the fifteenth aspect, by covering the piezoelectric layer with the thermosetting adhesive agent, it is possible to form an adhesive layer covering a side face of the piezoelectric layer easily and surely.

A sixteenth aspect of the present invention is the method of manufacturing a liquid-jet head according to any one of the fourteenth and fifteenth aspects, characterized in that, by heating and curing the adhesive agent, the adhesive agent is allowed to run along a side face of the draw-out wiring, thus covering the piezoelectric layer.

In the sixteenth aspect, by heating the adhesive agent, viscosity of the adhesive agent is temporarily lowered. Thus, it is possible to surely cover the piezoelectric layer with the adhesive agent by easily allowing the adhesive agent to run along the side face of the piezoelectric layer.

A seventeenth aspect of the present invention is the method of manufacturing a liquid-jet head according to the sixteenth aspect, characterized in that a heating step of curing the adhesive agent includes: a preliminary heating step of heating the adhesive agent at a temperature lower than a temperature at which viscosity of the adhesive agent in its viscosity-temperature properties becomes minimum and covering at least the side face of the piezoelectric layer with the adhesive agent; and a cure heating step of heating at a temperature to cure the adhesive agent applied in the preliminary heating step.

In the seventeenth aspect, the adhesive agent is heated in the preliminary heating step and the cure heating step. Thus, it is possible to surely cover the side face of the piezoelectric layer with the adhesive agent and to cure the adhesive agent without allowing the adhesive agent to flow out to an extra region.

An eighteenth aspect of the present invention is the method of manufacturing a liquid-jet head according to any one of the fourteenth to seventeenth aspects, characterized in that viscosity of the adhesive agent before curing thereof is 25±10Pa·s at 25° C.

In the eighteenth aspect, by using an adhesive agent having a predetermined viscosity, it is possible to surely cover the side face of the piezoelectric layer and to secure a good adhesive strength.

A nineteenth aspect of the present invention is the method of manufacturing a liquid-jet head according to the eighteenth aspect, characterized in that a thickness of the adhesive agent before the passage-forming substrate and the junction plate are joined together is 1.0 to 5.0 μm.

In the nineteenth aspect, by joining the passage-forming substrate and the junction plate by use of an adhesive agent having a predetermined thickness, it is possible to surely cover the side face of the piezoelectric layer and to secure the good adhesive strength.

A twentieth aspect of the present invention is the method of manufacturing a liquid-let head according to any one of the eighteenth and nineteenth aspects, characterized in that the adhesive agent is pressurized at a pressure of 0.1 to 1.0 MPa in allowing the junction plate to abut on the passage-forming substrate.

In the twentieth aspect, by pressing an adhesive agent having a predetermined viscosity at a predetermined pressure, it is possible to surely cover the side face of the piezoelectric layer and to secure the good adhesive strength.

The liquid-jet head of the present invention has particular effects as below. The liquid-jet head has a piezoelectric element provided by deposition and a lithography method without using an adhesive agent and covers a side of the piezoelectric element with an adhesive layer made of an insulating adhesive agent. Thus, it is possible to easily and surely prevent the damage to the piezoelectric element attributable to the external environment and also to improve the withstand voltage of the piezoelectric element. Moreover, as the adhesive layer covering the side face of the piezoelectric element, the adhesive agent used in joining the passage-forming substrate and the junction plate is used. Thus, the manufacturing process thereof can be simplified. Furthermore, even if a piezoelectric elements are disposed in high density by using a thin-film vibration plate and a thin-film piezoelectric element, the adhesion layer prevents occurrence of damage such as a crack and the like in the vibration plate. Even if a crack occurs therein, the adhesion layer surely prevents the liquid in the pressure generating chambers from flowing out towards the piezoelectric element. Thus, it is possible to prevent damage to the piezoelectric element attributable to the liquid.

Meanwhile, in Japanese Patent Laid-Open Nos. Hei 5 (1993)-42674, Hei 9 (1997)-234864 and Hei 6 (1994)-106724, there is disclosed a constitution, in which a piezoelectric element is adhered onto a vibration plate (on a reinforcement plate) via an adhesive agent interposed therebetween and this adhesive agent is provided on a side face of the piezoelectric element. However, the adhesive agent provided on the side face of the piezoelectric element is an adhesive agent which is used in joining the piezoelectric element on the vibration plate or on the reinforcement plate and protruded up to the side thereof. Moreover, the adhesive agent is provided in order to improve junction strength between the piezoelectric element and the vibration plate, to allow electrodes of the piezoelectric element to directly contact with the reinforcement plate or to surely isolate a FPC from the piezoelectric element. Therefore, the adhesive agent described above has a different object from that of the adhesive agent of the present invention, and so is apparently different in constitution. Moreover, in these prior arts, the constitution is not suggested, in which the adhesive agent is provided on the side face of the piezoelectric element for sealing the piezoelectric element in order to prevent damage to attributable to the external environment or for preventing the surface discharge of the piezoelectric element.

As described above, a structure, in which piezoelectric elements are formed without an adhesive agent interposed therebetween and are disposed in high density on a vibration plate, has not been disclosed. Moreover, a constitution of covering, with an adhesive agent, a side face of piezoelectric elements formed on a vibration plate by deposition and a lithography method has not been disclosed either. Such constitutions and effects cannot be easily invented even if the constitutions described above in the background of the invention are combined.

BRIEF DESCRIPTION OF THE DRAWINGS

FIG. 2A is a top plan view of the ink-jet recording head and FIG. 2B is a top plan view of a passage-forming substrate.

FIG. 3A is a cross-sectional view in a longitudinal direction of a pressure generating chamber and FIG. 3B is a cross-sectional view along the line A–A' in FIG. 3A.

FIG. 8A is a top plan view of the ink-jet recording head and FIG. 8B is atop plan view of a passage-forming substrate.

FIG. 10A is a cross-sectional view along the line C–C' in FIG. 9 and FIG. 10B is a cross-sectional view along the line D–D' in FIG. 9.

DESCRIPTION OF THE PREFERRED EMBODIMENTS

The present invention will be described in detail below based on an embodiment.

(Embodiment 1)

Figure 1:
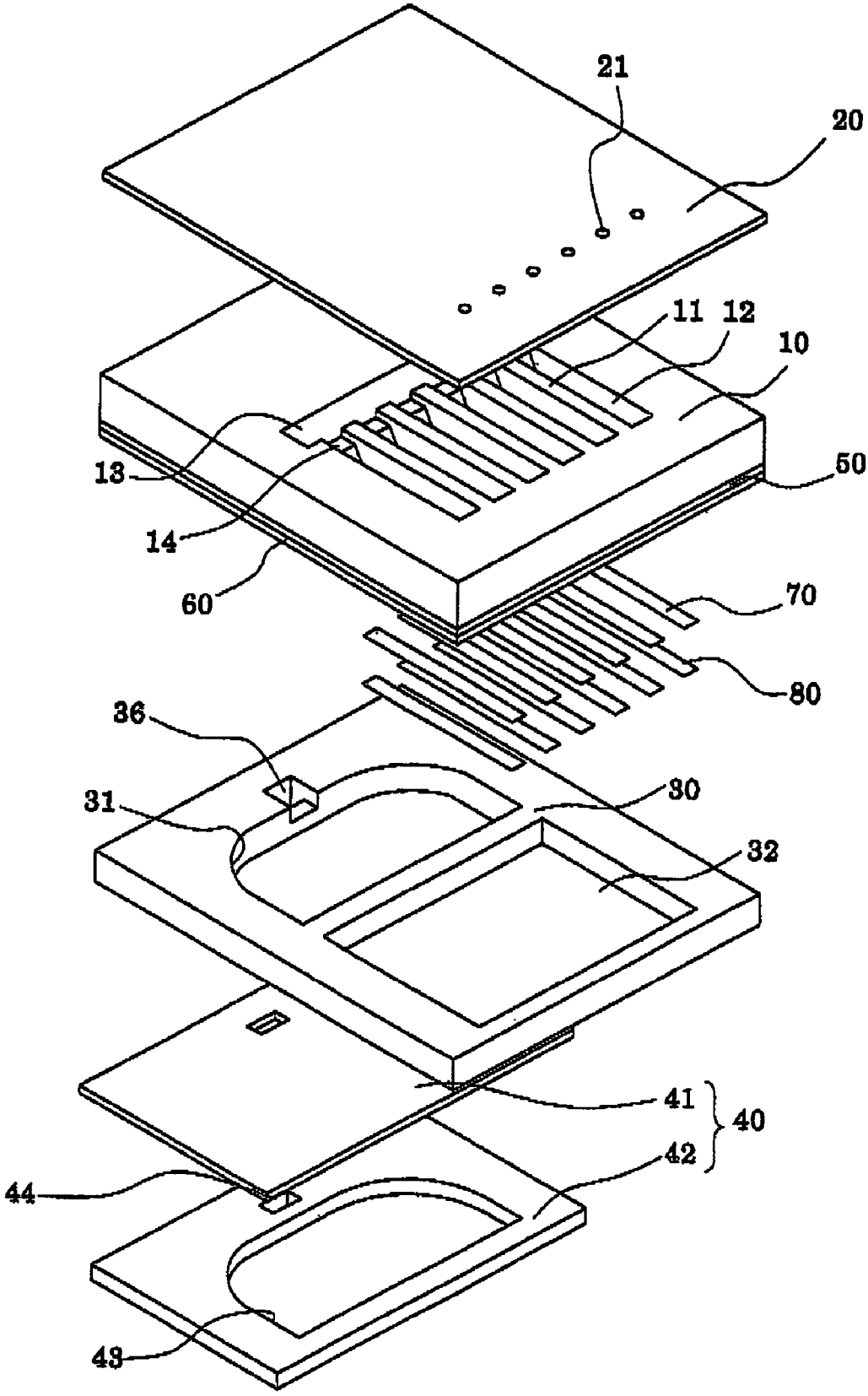
FIG. 1 is an exploded perspective view schematically showing an ink-jet recording head according to Embodiment 1 of the present invention.
Figure 2A:
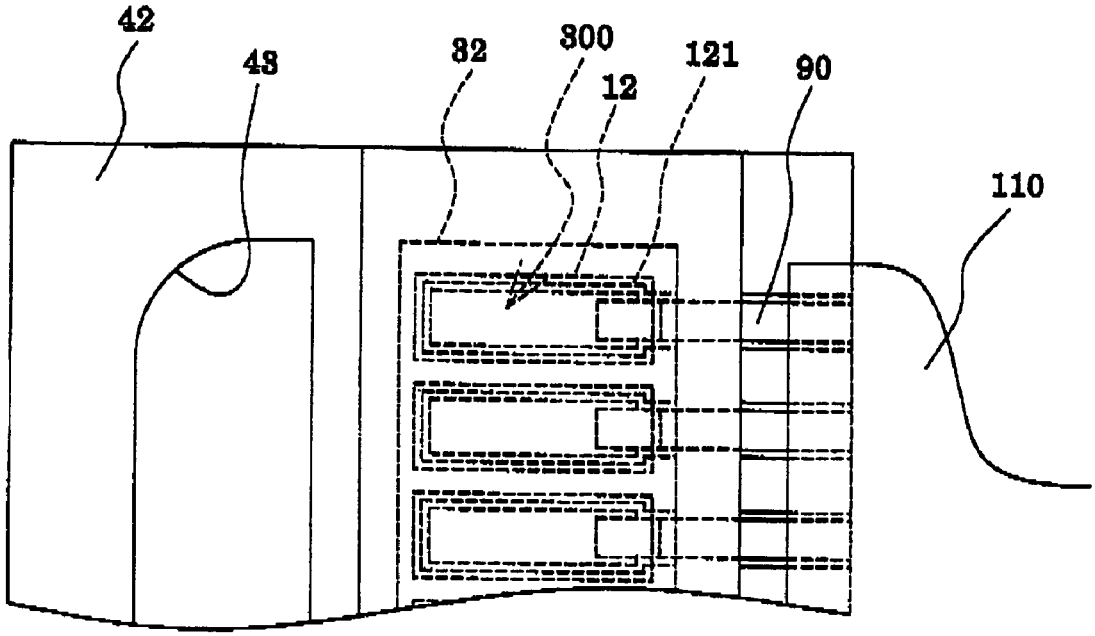
FIGS. 2A and 2B are top plan views showing the ink-jet recording head according to Embodiment 1 of the present invention.
Figure 2B:
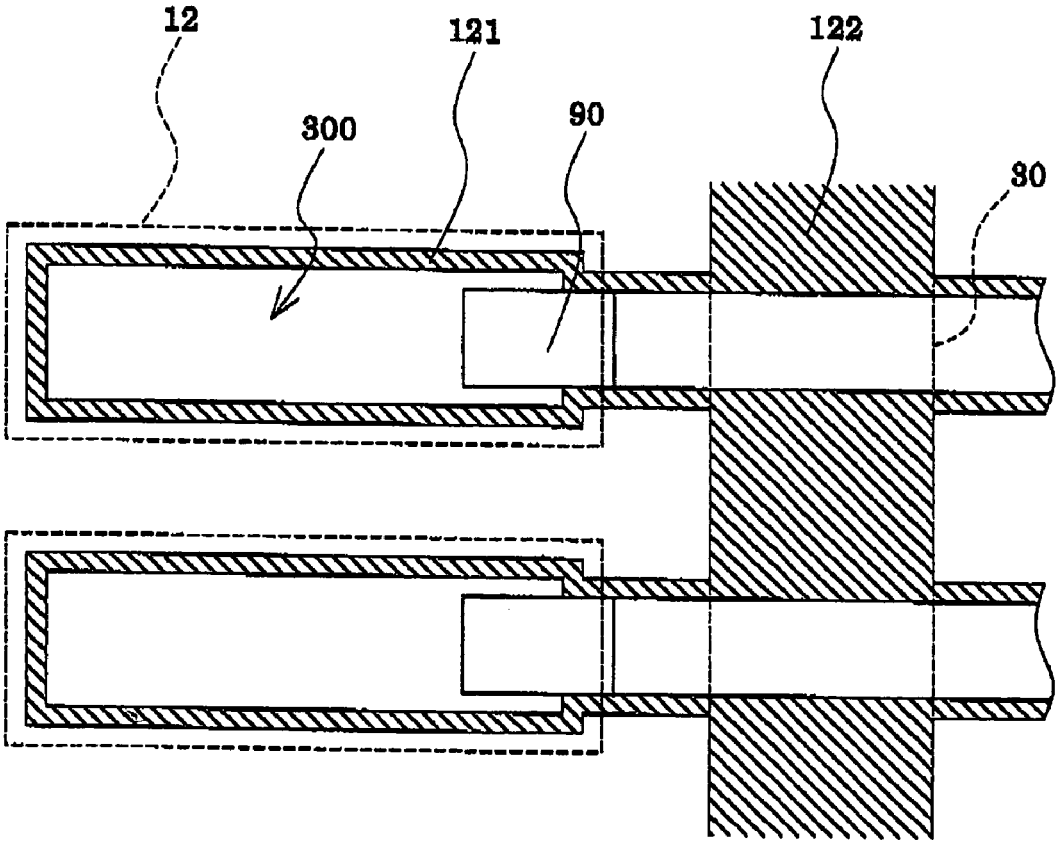
Figure 3A:
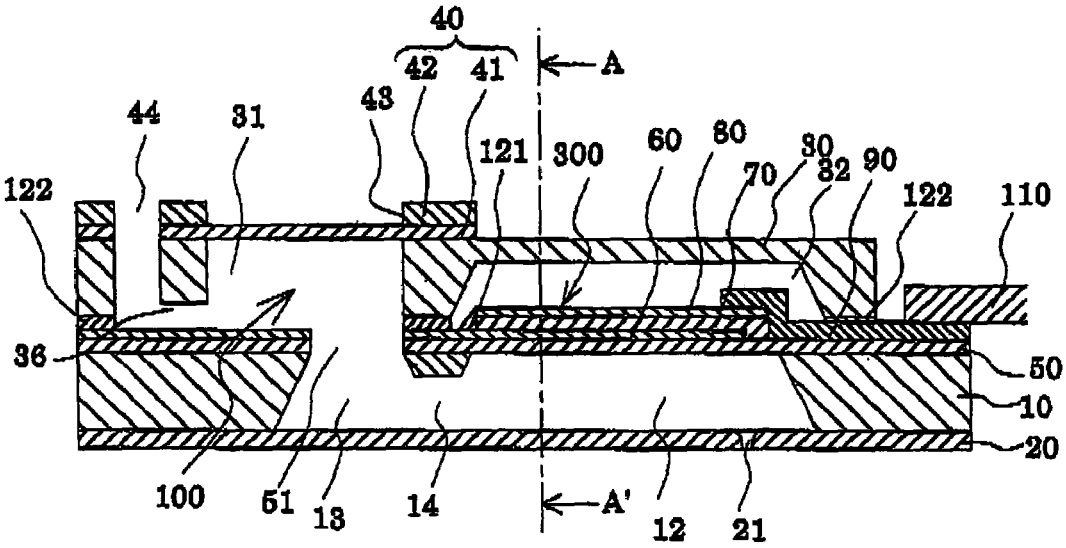
FIGS. 3A and 3B are cross-sectional views showing the ink-jet recording head according to Embodiment 1 of the present invention.
Figure 3B:
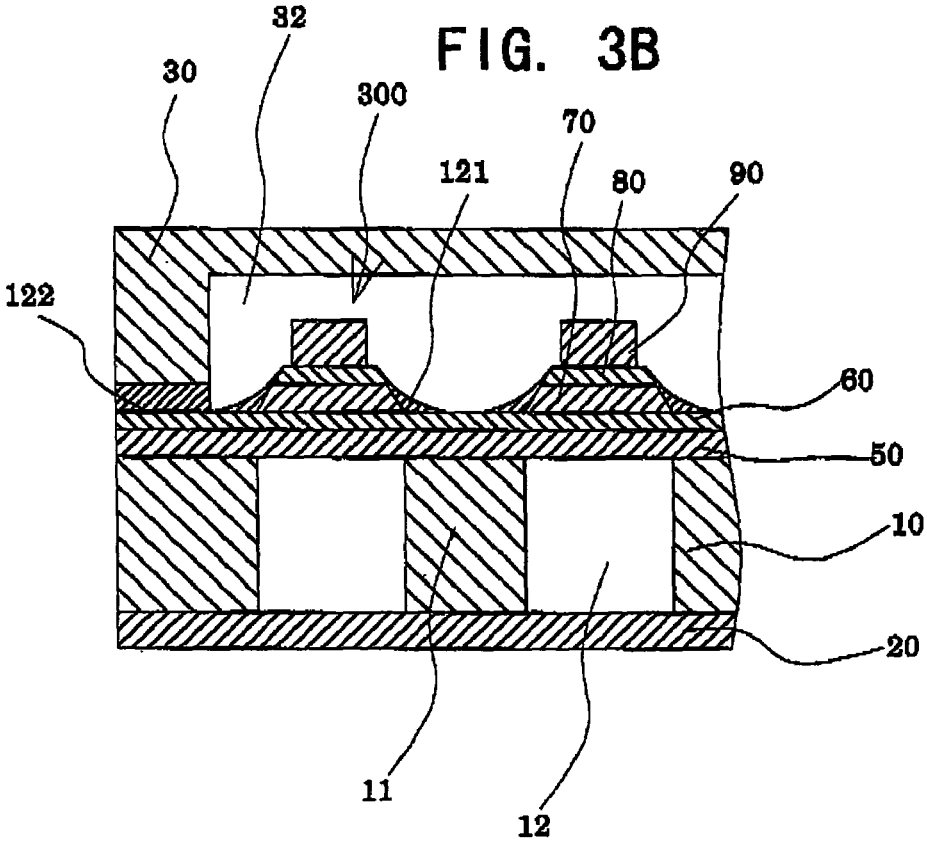

FIG. 1 is an exploded perspective view showing an ink-jet recording head according to Embodiment 1 of the present invention. FIG. 2A is a top plan view of the ink-let recording head and FIG. 2B is a top plan view of a passage-forming substrate. FIG. 3A is a cross-sectional view in a longitudinal direction of a piezoelectric element of the ink-jet recording head and FIG. 3B is a cross-sectional view of the line A–A' of FIG.3A.

As illustrated, a passage-forming substrate 10 is made of a single crystal silicon substrate of a plane orientation (110) in this embodiment. On one surface of the passage-forming substrate 10 is formed an elastic film 50 which is made of a thin film of 1 to 2 μm thick of silicon dioxide formed by thermal oxidation in advance.

On this passage-forming substrate 10, pressure generating chambers 12 partitioned by a plurality of compartment walls are formed by carrying out anisotropic etching from the other side of the passage-forming substrate 10. Moreover, on the outside of each line in a longitudinal direction of the pressure generating chambers 12, there are formed communicating portions 13, which communicate, via a communicating hole 51, with a reservoir portion 31 provided in a reservoir forming plate 30 that is a junction plate to be described later, and constitutes a part of a reservoir 100 forming a common ink chamber to each of pressure generating chambers 12. Moreover, the communicating portion 13 is made to communicate via ink supply paths 14 with one ends in the longitudinal direction of the each pressure generating chamber 12.

Here, the anisotropic etching is carried out by utilizing a difference in etching rates of the single crystal silicon substrate. For example, in this embodiment, the anisotropic etching is carried out by utilizing the following property of the single crystal silicon substrate. Specifically, when the single crystal silicon substrate is immersed in an alkaline solution such as KOH, it is gradually eroded and there emerge a first (111) plane perpendicular to the (110) plane and a second (111) plane forming an angle of about 70 degrees to the first (111) plane and an angle of about 35 degrees to the above-described (110) plane. As compared with an etching rate of the (110) plane, an etching rate of the (111) plane is about 1/180. With such anisotropic etching, it is possible to perform high-precision processing based on depth processing in a parallelogram shape formed of two of the first (111) planes and two of the second (111) planes slant thereto, and thus the pressure generating chambers 12 can be arranged in a high density.

In this embodiment, long sides of each pressure generating chamber 12 are formed of the first (111) planes, and short sides thereof are formed of the second (111) planes. These pressure generating chambers 12 are formed by etching the passage-forming substrate 10 until the etching almost penetrates through the passage-forming substrate 10 to reach the elastic film 50. Here, the elastic film 50 is eroded extremely little by the alkaline solution used for etching the single crystal silicon substrate. Moreover, each ink supply path 14 communicating with an end of the pressure generating chambers 12 is formed to be shallower than the pressure generating chambers 12, and thus the passage resistance of ink flowing into the pressure generating chambers 12 is maintained constant. Specifically, the ink supply paths 14 are formed by etching the single crystal silicon substrate partway in the thickness direction (half-etching). Note that the half-etching is carried out by adjusting an etching time.

As to the thickness of the passage-forming substrate 10 as described above, an optimal thickness can be selected in accordance with the arrangement density of the pressure generating chambers 12. When the arrangement density of the pressure generating chambers 12 is, for example, about 180 dots, per inch (180 dpi), the thickness of the passage-forming substrate 10 may be about 220 μm. However, for example, in the case of arranging the pressure generating chambers in a relatively high density such as 200 dpi or more, it is preferable that the thickness of the passage-forming substrate 10 is made to be as relatively thin as 100 μm or less. This is because the arrangement density can be increased while maintaining the rigidity of the compartment walls between the adjacent pressure generating chambers 12.

On the opening surface side of the passage-forming substrate 10, a nozzle plate 20 having nozzle orifices 21 drilled therein is fixedly adhered via an adhesive agent or a thermowelding film, each nozzle orifice 21 communicating with the pressure generating chamber 12 at a spot opposite to the ink supply paths 14. Note that the nozzle plate 20 is made of glass, ceramics, stainless steel or the like, which has a thickness of, for example, 0.05 to 1 mm and a linear expansion coefficient of, for example, 2.5 to 4.5 [$\times 10^{-6}$/° C.] at a temperature of 300° C. or lower, With one surface, the nozzle plate 20 wholly covers one surface of the passage-forming substrate 10 and also serves as a reinforcement plate for protecting the single crystal silicon substrate from a shock or an external force. The nozzle plate 20 can be formed of a material having a thermal expansion coefficient approximately equal to that of the passage-forming substrate 10. In this case, since deformations of the passage-forming substrate 10 and the nozzle plate 20 due to heat is approximately the same, the passage-forming substrate 10 and the nozzle plate 20 can be easily Joined to each other by use of a thermosetting adhesive and the like.

Here, a size of the pressure generating chambers 12 applying an ink droplet ejection pressure to ink and a size of the nozzle orifices 21 ejecting ink droplets are optimized in accordance with an amount of ejected ink droplets, an ejection speed thereof and an ejection frequency thereof. For example, in a case where 360 ink droplets per inch are recorded, it is necessary to form the nozzle orifices 21 of several ten micrometers in diameter with good precision.

Meanwhile, on the opposite side of the elastic film 50 to the opening surface of the passage-forming substrate 10, a lower electrode film 60 having a thickness of, for example, about 0.2 μm, a piezoelectric layer 70 having a thickness of, for example, about 0.5 to 5 μm, and an upper electrode film 80 having a thickness of, for example, about 0.1 μm are laminated in a process to be described later, thus constituting a piezoelectric element 300. Here, the piezoelectric element 300 means a portion including the lower electrode film 60, the piezoelectric layer 70 and the upper electrode film 80. In general, the piezoelectric element 300 is constituted in such a way that any one of electrodes thereof is set to be a common electrode and the other electrode and the piezoelectric layer 70 are patterned for each pressure generating chamber 12. Here, a portion, which is constituted of the patterned electrode and the patterned piezoelectric layer 70, and where a piezoelectric distortion is generated by application of a voltage to both of the electrodes, is referred to as a piezoelectric active portion. In this embodiment, the lower electrode film 60 is made to be a common electrode of the piezoelectric element 300, and the upper electrode film 80 is made to be an individual electrode of the piezoelectric element 300. However, no impediment occurs even if the above-described order is reversed for the convenience of a drive circuit or wiring. In any case, a piezoelectric active portion will be formed for each pressure generating chamber. In addition, here, a combination of the piezoelectric element 300 and a vibration plate in which displacement occurs due to the drive of the piezoelectric element 300 is referred to as a piezoelectric actuator. Note that, in the above-described example, the lower electrode film 60 of the piezoelectric element 300 and the elastic film 50 function as the vibration plate.

Moreover, in the vicinity of the end portion of the passage-forming substrate 10, an external wiring 110 for driving the piezoelectric element 300 is provided. This external wiring 110 and the piezoelectric element 300 are electrically connected to each other via a draw-out wiring drawn out from the piezoeleotric element 300 to the external wiring 110.

In this embodiment, as the draw-out wiring, a lead electrode 90 made of, for example, gold (Au) and the like is provided, which is extended from the vicinity of the one end portion in the longitudinal direction of the upper electrode film 80 to the vicinity of the end portion of the passage-forming substrate 10.

Moreover, on the side face of the piezoelectric element 300, an adhesion layer 121 is provided, which covers the piezoelectric layer 70 so that at least the surface thereof is not exposed. In this embodiment, the adhesion layer 121 is provided so as to also cover the side face of the upper electrode 80.

To be more specific, in this embodiment, the adhesion layer 121 is provided over a square portion defined by a boundary between the side faces of the piezoelectric layer 70 and the upper electrode film 80, and the lower electrode film 60 and the elastic film 50, and also over a square portion defined by a boundary between the side face of the lead electrode 90 and the side face of the elastic film 50.

On the passage-forming substrate 10 where the piezoelectric elements 300 as described above are formed, that is, on the lower electrode film 60, elastic film 50 and lead electrode 90, the reservoir forming plate 30 having the reservoir portion 31 constituting at least a part of the reservoir 100 is joined via a junction layer 122 formed of an adhesive agent. In this embodiment, the reservoir portion 31 is formed across the width direction of the pressure generating chambers 12 by penetrating the reservoir forming plate 30 in its thickness direction. Thus, as described above, the reservoir portion 31 constitutes the reservoir 100 to be a common ink chamber for the pressure generating chambers 12 while communicating with the communicating portions 13 of the passage-forming substrate 10.

Moreover, in a region of the reservoir forming plate 30 facing the piezoelectric elements 300, a piezoelectric element holding portion 32 is provided, which has a space secured to an extent not to hinder a movement of the piezoelectric elements 300.

For the reservoir forming plate 30 as described above, it is preferable to use a material, for example, glass, a ceramic material and the like, which has approximately the same thermal expansion coefficient as that of the passage-forming substrate 10. In this embodiment, the reservoir forming plate 30 is formed by using a single crystal silicon substrate, which is the same material as the passage-forming substrate 10.

Moreover, as the adhesive agent used for joining the reservoir forming plate 30 and the passage-forming substrate 10 as described above, it is necessary to use an insulating adhesive agent so as to electrically isolate the lead electrodes 90 from each other and also isolate the lead electrode 90 from the lower electrode film 60. This is because, if a conductive adhesive agent is used, short-circuiting occurs between the lead electrodes provided in parallel, and between the lead electrode 90 and the lower electrode film 60. As such an insulating adhesive agent, for example, a thermosetting adhesive agent such as an epoxy adhesive and the like can be cited.

As described above, in the junction between the reservoir forming plate 30 and the passage-forming substrate 10 by use of the thermosetting adhesive agent, for example, when the adhesive agent is heated while the passage-forming substrate 10 and the reservoir forming plate 30 are made to abut against each other in a state where the adhesive agent is applied thereon, viscosity of the adhesive agent is lowered. Then, by the surface tension thereof, the adhesive agent covers the side face of the piezoelectric element 300 across the square portion defined by the boundary between the side face of the lead electrode 90 and the elastic film 50 on the passage-forming substrate 10. By heating the adhesive agent as described above, the adhesion layer 121 can be formed on the side face of the piezoelectric element 300, and the passage-forming substrate 10 and the reservoir forming plate 30 can be join together by interposing the junction layer 122 therebetween.

As described above, according to the ink-jet recording head of this embodiment, the adhesion layer 121, which is formed of the adhesive agent used for the junction between the passage-forming substrate 10 and the reservoir forming plate 30, covers the side face of the piezoelectric element 300 so as not to expose at least the piezoelectric layer 70 thereof. Thus, surface discharge at the end surface of, particularly, the piezoelectric layer 70 of the piezoelectric element 300 is prevented, thereby improving a withstand voltage of the piezoelectric element 300. At the same time, damage to the piezoelectric element 300 attributable to an external environment can be easily and surely prevented and the manufacturing process thereof can be simplified.

Moreover, in this embodiment, in order that the piezoelectric elements 300 and the nozzle orifices 21 are disposed in a high density, the vibration plate comprising the elastic film 50 and the lower electrode film 60 is made of a thin film and the piezoelectric elements 300 are formed not by adhesion via the adhesive agent but by deposition. Thus, due to deformations of the piezoelectric elements 300, a crack is likely to occur on the vibration plate in a region defined by the side of the piezoelectric element 300 and the lower electrode film 60. On the vibration plate facing the side face of the piezoelectric element 300 where such a crack is likely to occur, the adhesion layer 121 is provided. Thus, the rigidity of the vibration plate can be improved and the occurrence of the crack can be prevented. Moreover, even if the crack occurs in the vibration plate, the crack is sealed by the adhesion layer 121. Thus, the ink in the pressure generating chambers 12 can be prevented from flowing out to the side of the piezoelectric elements via the crack and damage to the piezoelectric elements 300 attributable to the ink can be surely prevented.

Furthermore, for the adhesive agent forming the adhesion layer 121, in order to surely prevent damage to the piezoelectric elements 300 attributable to the external environment by the adhesion layer 121, it is preferable to use an adhesive agent having a gas permeability of $1\times10^{-3}$Pa·m$^3$/sec or less.

Moreover, the adhesion layer 121 is formed while covering the side face of the piezoelectric elements 300 by the surface tension of the adhesive agent. Thus, an angle of the inclination of the surface of the adhesion layer 121 becomes uniform.

Accordingly, in forming each piezoelectric element 300 by patterning, even if there occurs a variation of angles on the side faces of each piezoelectric elements 300 in its arrangement direction, outer shapes of all the piezoelectric elements 300 are made to be substantially the same by the adhesion layer 121. Thus, ink ejection properties such as an ejection amount of ink ejected from the respective pressure generating chambers 12, an ejection speed thereof and the like can be stabilized.

Note that, in this embodiment, in order to prevent damage to the piezoelectric elements 300 attributable to the external environment by covering the side face of the piezoelectric layer 70 with the adhesion layer 121, there is no need to hermetically seal the piezoelectric element holding portion 32 of the reservoir forming plate 30. However, by hermetically sealing the piezoelectric element holding portion 32, damage to the piezoelectric elements 300 attributable to the external environment can be further surely prevented.

Moreover, on such a reservoir forming plate 30, a compliance plate 40 comprising a sealing film 41 and a fixing plate 42 is joined. Herein, the sealing film 41 is made of a material having flexibility with low rigidity (for example, a polyphenylene sulphide (PPS) film of 6 μm thickness), and one side face of the reservoir portion 31 is sealed by this sealing film 41. Moreover, the fixing plate 42 is formed of a hard material such as metal (for example, stainless steel (SUS) of 30 μm thickness and the like). A region of this fixing plate 42 facing the reservoir 100 is an opening portion 43 where the fixing plate is completely removed in its thickness direction. Thus, one side face of the reservoir 100 is sealed only with the sealing film 41 having flexibility, Moreover, on the compliance plate 40 outside the roughly center portion of the reservoir 100 in the longitudinal direction, an ink introducing port 44 for supplying ink to the reservoir 100 is formed. Furthermore, in the reservoir forming plate 30 is provided an ink introducing path 36 for communicating the ink introducing port 44 to a side wall of the reservoir 100.

The ink-jet recording head of this embodiment as described above takes in ink from the ink introducing port 44 connected to unillustrated external ink supplying means, and allows the ink to fill the inside thereof from the reservoir 100 to the nozzle orifices 21. Then, in accordance with a recording signal from a drive circuit, the ink-jet recording head applies a voltage between the lower electrode film 60 and the upper electrode film 80, which correspond to each pressure generating chamber 12, and the elastic film 50, the lower electrode film 60 and the piezoelectric layer 70 are subjected to flexural deformation. Thus, the pressure in each pressure generating chamber 12 is increased, and ink droplets are ejected from each nozzle orifice 21.

There is no particular limitation on a method of manufacturing the ink-jet recording head of this embodiment described above. Referring to FIGS. 4 to 6, description will be made for an example of the method. FIGS. 4 to 6 are cross-sectional views illustrating a part of the pressure generating chamber 12 in the longitudinal direction.

Figure 4A:
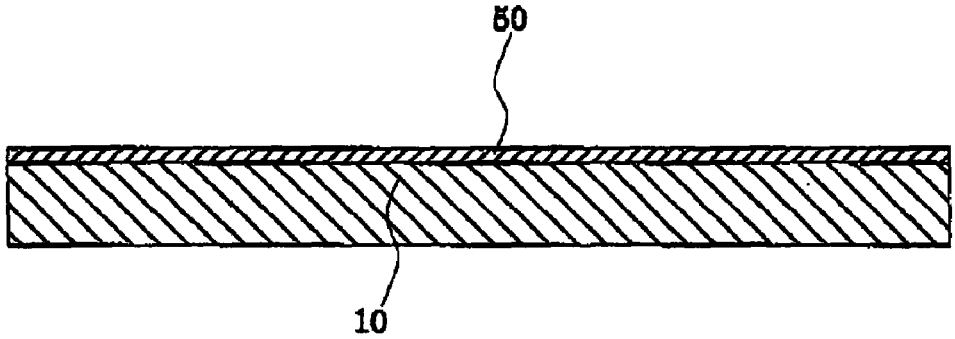
FIGS. 4A to 4D are cross-sectional views in the longitudinal direction of the pressure generating chamber, showing steps of manufacturing the ink-jet recording head according to Embodiment 1 of the present invention.

First, as shown in FIG. 4A, a wafer as a single crystal silicone substrate to be the passage-forming substrate 10 is thermally oxidized in a diffusion furnace at about 1100° C., thereby forming the elastic film 50 made of silicone dioxide.

Figure 4B:
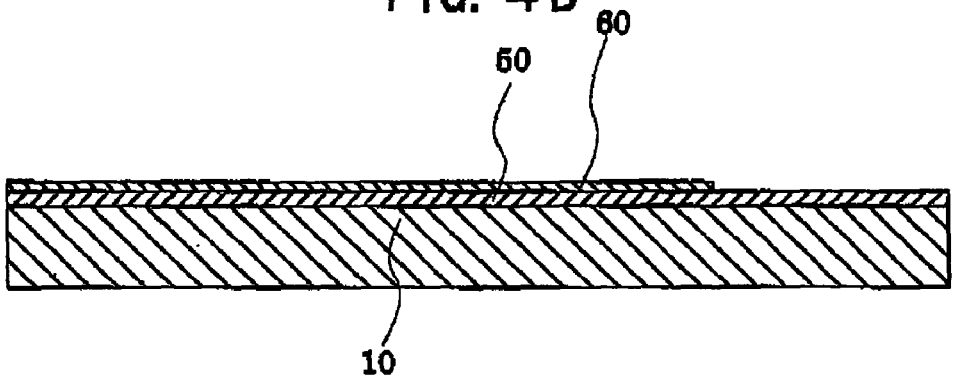

Next, as shown in FIG. 4B, after the lower electrode film 60 is formed on the entire surface of the elastic film 50 by a sputtering method, an overall pattern is formed by patterning on the lower electrode film 60. For the material of this lower electrode film 60, platinum (Pt) and the like is preferred. This is because the piezoelectric layer 70 to be described later, which is deposited by a sputtering method or a sol-gel method, needs to be crystallized by baking at about 600 to 1000° C. under the atmospheric atmosphere or the oxygen atmosphere after deposition. Specifically, the material of the lower electrode film 60 has to be able to maintain conductivity at such a high temperature and under such an oxidation atmosphere. Particularly, when lead zirconate titanate (PZT) is used as the piezoelectric layer 70, it is preferable that a change in conductivity due to diffusion of lead oxide is small. In view of the above reasons, platinum is preferred for the material of the lower electrode film 60.

Figure 4C:
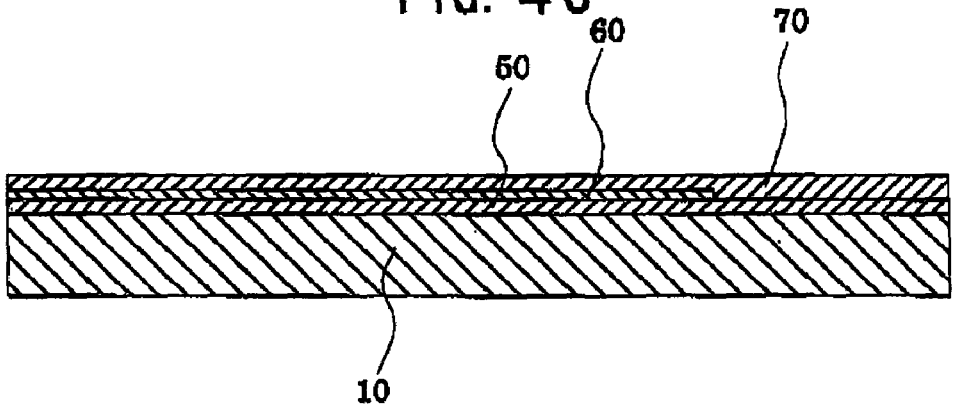

Next, as shown in FIG. 4C, the piezoelectric layer 70 is deposited. In the piezoelectric layer 70, crystals are preferably orientated. In this embodiment, for example, by use of a so-called sol-gel method, the piezoelectric layer 70 was formed, in which the crystals are orientated. Specifically, in the sol-gel method, so-called a sol, where a metal-organic matter dissolved/dispersed in a solvent, is applied and dried to be gel, and the gel is further baked at a high temperature, thus obtaining the piezoelectric layer 70 made of a metal oxide. For the material of the piezoelectric layer 70, a material of lead-zirconate-titanate series is preferred for the use of manufacturing the ink-jet recording head. Note that there is no particular limitation on a method of depositing the above-described piezoelectric layer 70, and a sputtering method, for example, may be used for the formation thereof.

Furthermore, a method may be used, in which a precursor film of lead zirconate titanate is formed by the sol-gel method, the sputtering method or the like, and thereafter, the precursor film is subjected to crystal growth in an alkaline solution at a low temperature by high-pressure processing.

In any case, the piezoelectric layer 70 thus deposited has a priority orientation of crystals, unlike bulk piezoelectric material. Moreover, in this embodiment, the piezoelectric layer 70 has its crystals formed in a columnar shape. Note that the priority orientation means a state where orientation directions of crystals are not in disorder, but particular crystalline planes are directed in an approximately constant direction. Moreover, a thin film with columnar-shaped crystals means a state of thin film formation where roughly cylindrical crystals are aggregated along a plane direction of the thin film in a state of central axes of the crystals approximately coinciding with each other in a thickness direction thereof. Needless to say, the piezoelectric layer can be a thin film formed of priority-orientated granular crystals. Incidentally, the piezoelectric layer thus fabricated in a thin film process has a thickness, in general, of 0.2 to 5 μm.

Figure 4D:
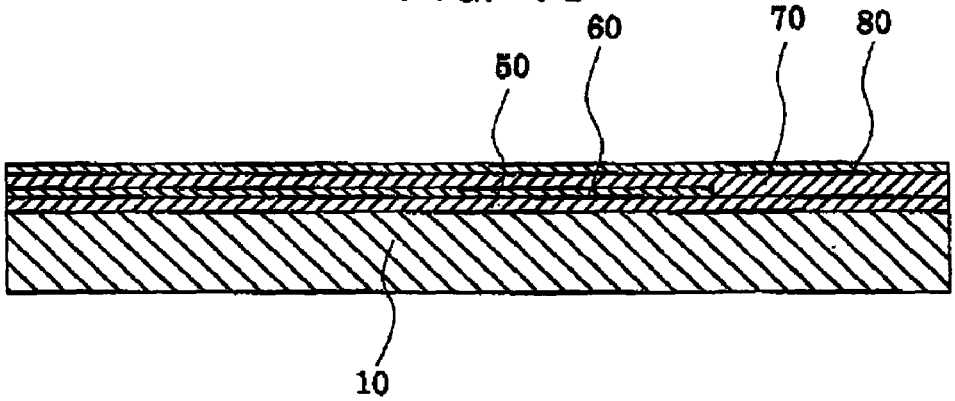

Next, as shown in FIG. 4D, the upper electrode film 80 is deposited. It is sufficient that the upper electrode film 80 is made of a material having high conductivity. Many kinds of metal including aluminum, gold, nickel, platinum and the like, and a conductive oxide and the like can be used to form the upper electrode film 80. In this embodiment, platinum is deposited by sputtering.

Figure 5A:
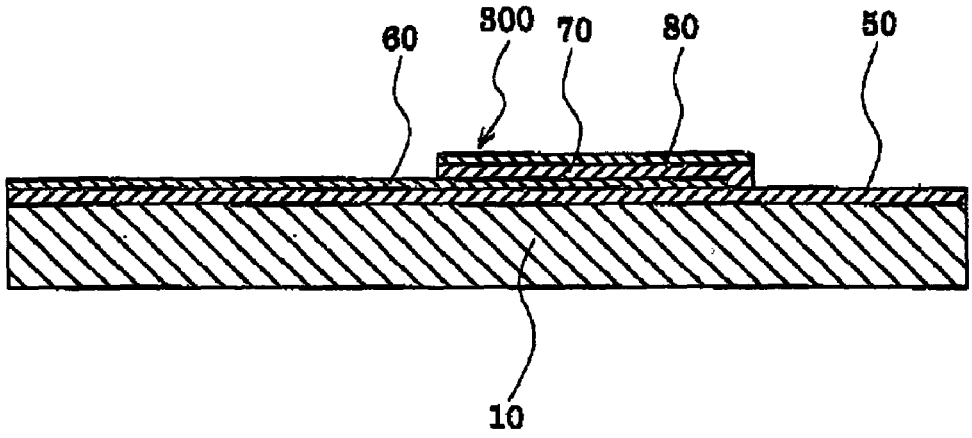
FIGS. 5A to 5C are cross-sectional views in the longitudinal direction of the pressure generating chamber, showing the steps of manufacturing the ink-jet recording head according to Embodiment 1 of the present invention.

Subsequently, as shown in FIG. 5A, only the piezoelectric layer 70 and the upper electrode film 80 are etched to perform patterning of the piezoelectric element 300.

Figure 5B:
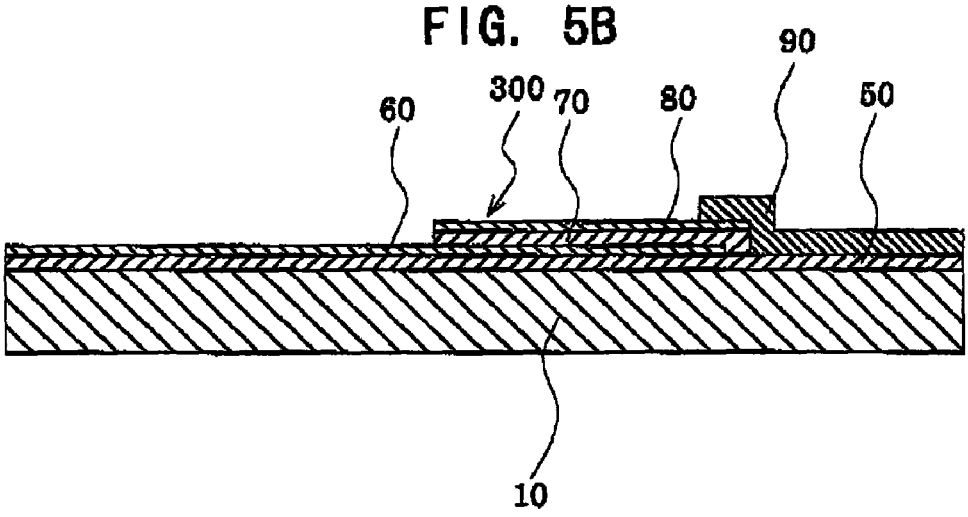

Thereafter, as shown in FIG. 5B, the lead electrode 90 is formed. Specifically, the lead electrode 90 made of, for example, gold (Au) and the like is formed over the entire surface of the passage-forming substrate 10, and at the same time, patterning of the lead electrode 90 is performed for each piezoelectric element 300.

Figure 5C:
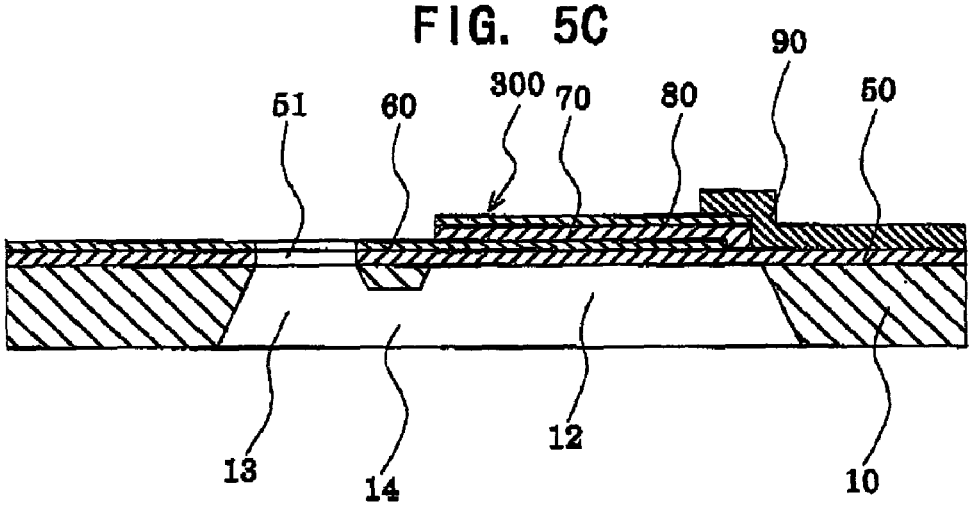

The above-described steps are the film formation process. After performing the film formation as described above, the foregoing anisotropic etching is carried out to the single crystal silicone substrate by the alkaline solution. Then, as shown in FIG. 5C, the pressure generating chamber 12, the communicating portion 13, the ink supply path 14 and the like are formed.

Next, the passage-forming substrate 10 and the reservoir forming plate 30 are joined together by the junction layer 122. At the same time, the adhesion layer 121 is formed on the side faces of the piezoelectric layer 70 and upper electrode film 80.

Figure 6A:
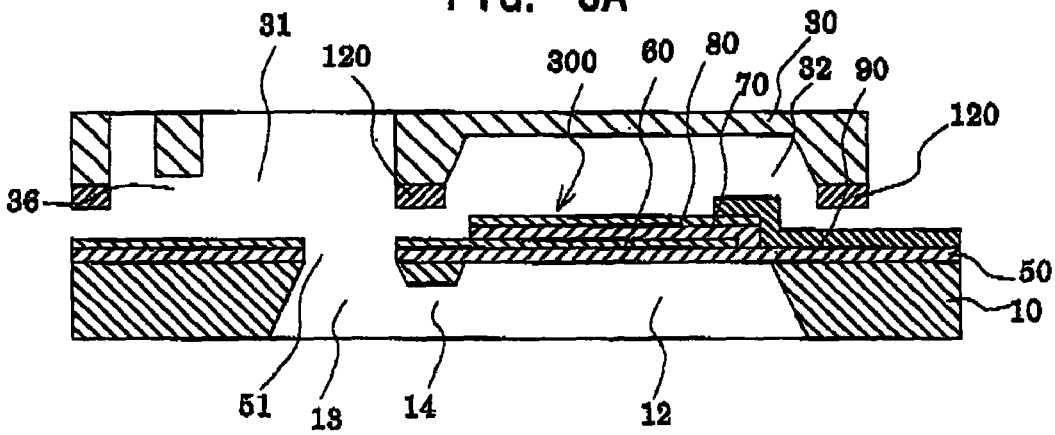
FIGS. 6A to 6C are cross-sectional views in the longitudinal direction of the pressure generating chamber, showing the steps of manufacturing the ink-jet recording head according to Embodiment 1 of the present invention.

To be more specific, first, as shown in FIG. 6A, the adhesive agent 120 is applied to a bottom of the reservoir forming plate 30 in which the piezoelectric element holding portion 32, the reservoir portion 31 and the like are previously formed. Then, the bottom of the reservoir forming plate 30 is abutted on the passage-forming substrate 10 with the adhesive agent 120 interposed therebetween.

Figure 6B:
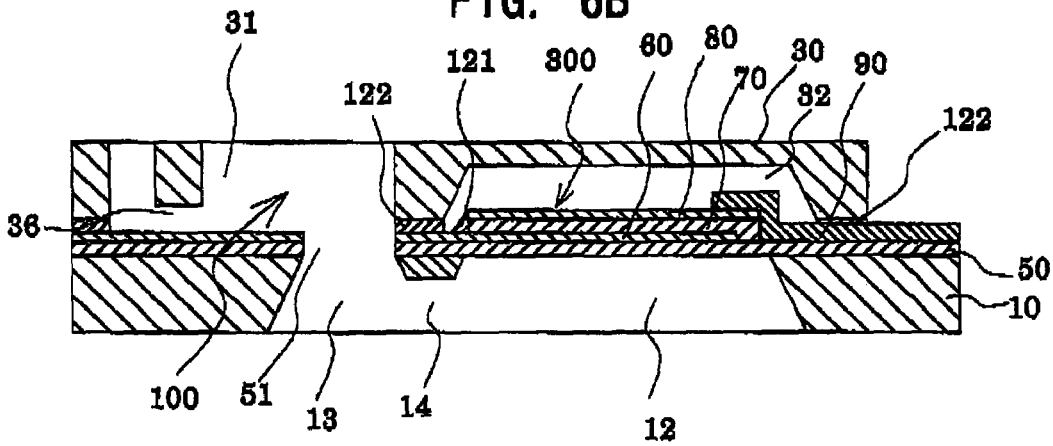

Next, as shown in FIG. 6B, the adhesion layer 121 is formed on the side face of the piezoelectric element 300 by heating the adhesive agent 120. At the same time, the passage-forming substrate 10 and the reservoir forming plate 30 are joined together with the junction layer 122 interposed therebetween.

Specifically, when the adhesive agent 120 is heated to be cured, the viscosity of the adhesive agent 120 is lowered before reaching a temperature at which the adhesive agent 120 is cured. Thus, due to the surface tension of the adhesive agent 120, the adhesive agent 120 flows out into the square portion defined by the elastic film 50 and the lead electrode 90 on the passage-forming substrate 10. As a result, with the adhesive agent 120 flowing out, the square portion defined by the boundary between the side faces of the piezoelectric layer 70 and the upper electrode film 80, and the lower electrode film 60 and the elastic film 50 is covered. Then, the adhesive agent 120 is cured to simultaneously form the junction layer 122 connecting the passage-forming substrate 10 with the reservoir forming plate 30, and the adhesive layer 121 preventing damage to the piezoelectric element 300 attributable to the external environment. Thus, the manufacturing process can be simplified and at the same time, the manufacturing costs can be reduced.

Moreover, damage to the piezoelectric element 300 attributable to the external environment is prevented by use of the adhesive agent 120 joining the passage-forming substrate 10 and, the reservoir forming plate 30 together and, at the same time, the adhesion layer 121 for improving the withstand voltage of the piezoelectric element 300 is formed. Thus, the process of hermetically sealing the piezoelectric element holding portion 32 becomes unnecessary and it is possible to simplify the manufacturing process.

Figure 6C:
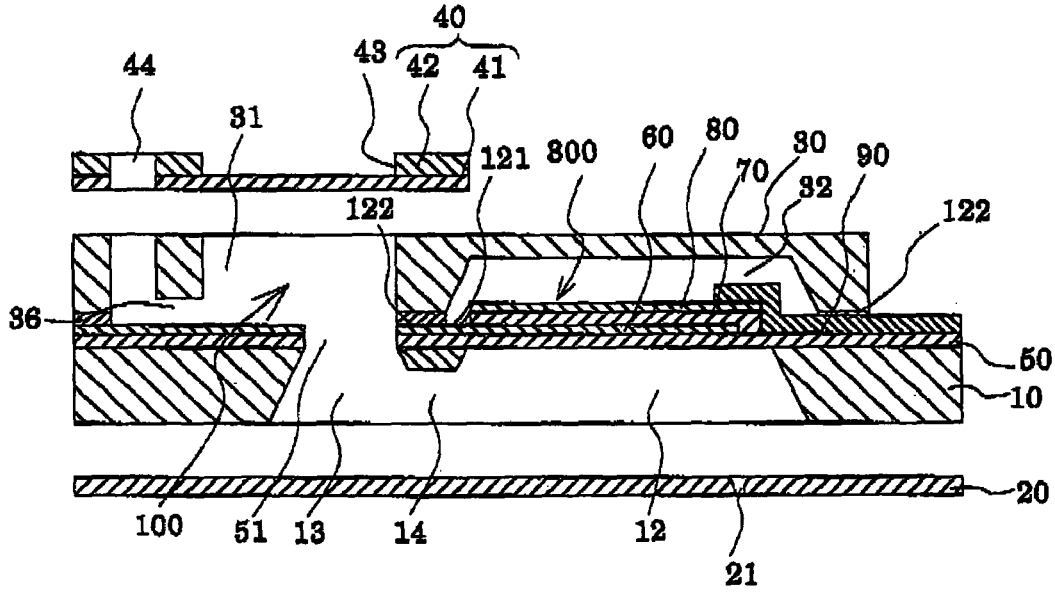

Subsequently, as shown in FIG. 6C, the nozzle plate 20 with the nozzle orifices 21 drilled therein is joined onto the opposite side of the passage-forming substrate 10 to the reservoir forming plate 30, and the compliance plate 40 is joined onto the reservoir forming plate 30. Thus, the ink-jet recording head of this embodiment is formed.

Note that, practically, a number of chips are simultaneously fabricated on one piece of wafer by a series of the above-described film formation and anisotropic etching. Then, after the completion of the process, the wafer is divided into passage-forming substrates 10 of one chip size as shown in FIG. 1. Thereafter, the reservoir forming plate 30 and the compliance plate 40 are sequentially adhered onto the divided passage-forming substrate 10 to be unified, thus obtaining the ink-jet recording head.

(Embodiment 2)

Figure 7:
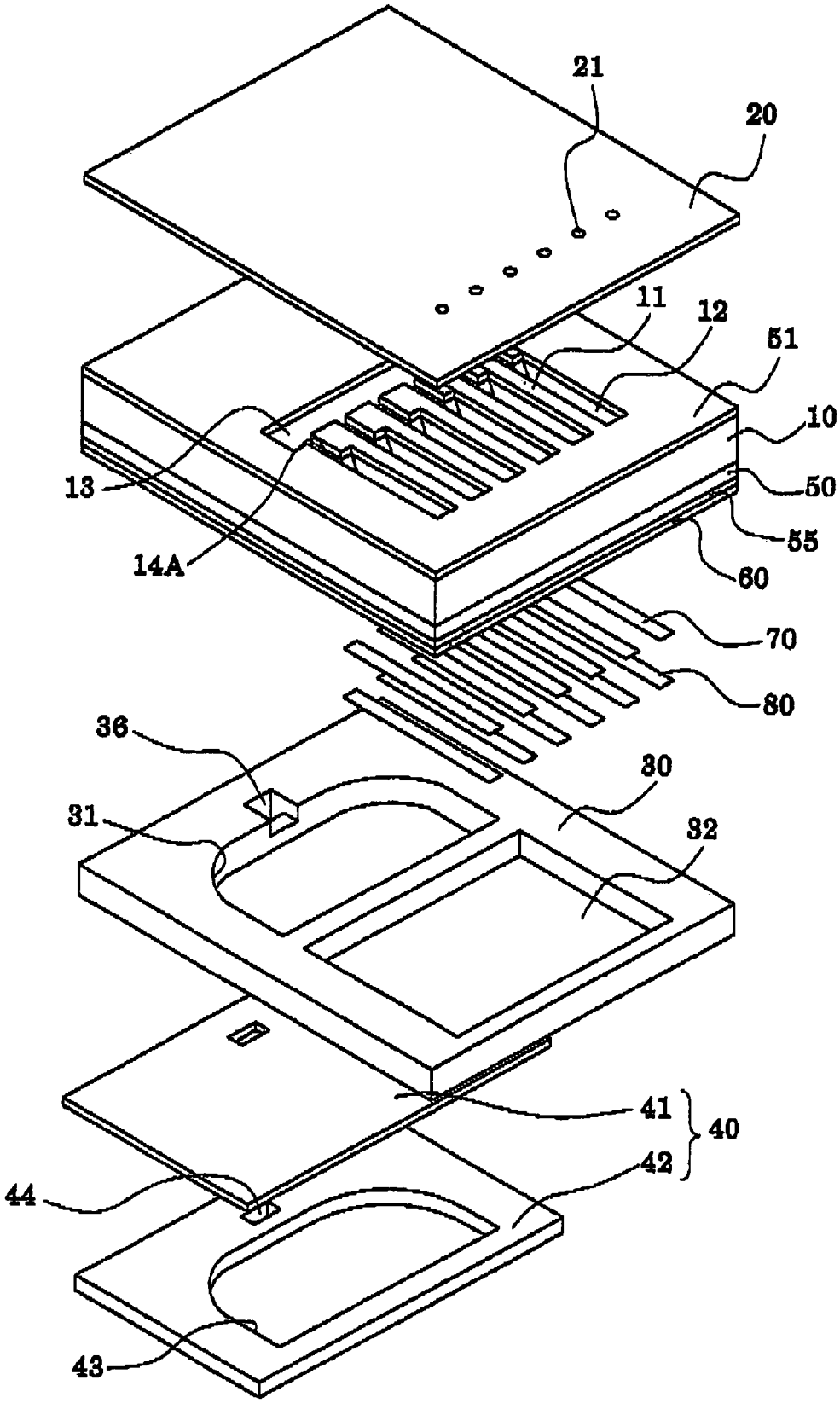
FIG. 7 is an exploded perspective view schematically showing an ink-jet recording head according to Embodiment 2 of the present invention.
Figure 8A:
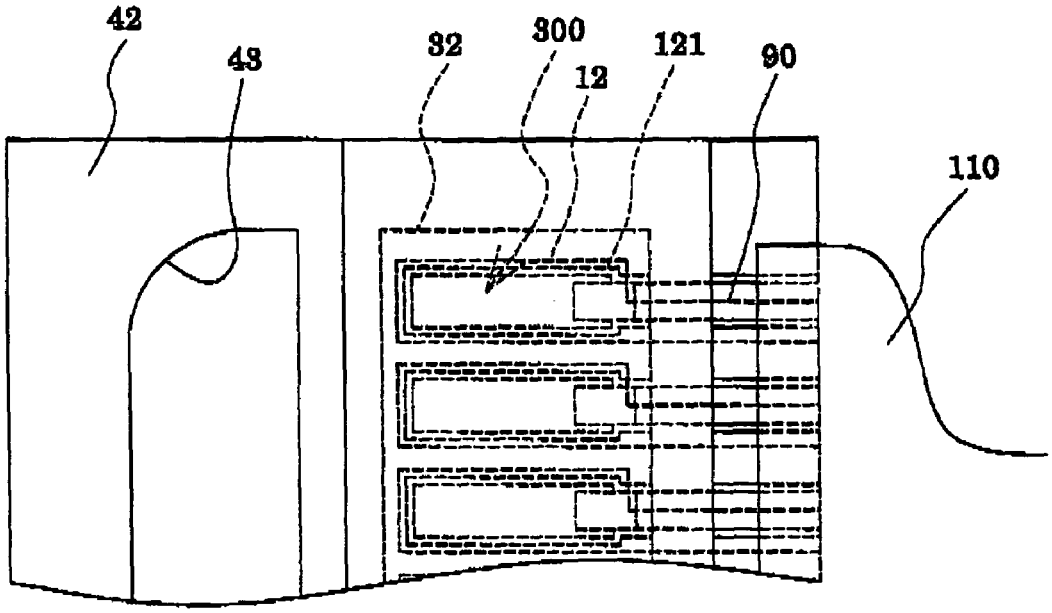
FIGS. 8A and 8B are top plan views showing the ink-jet recording head according to Embodiment 2 of the present invention.
Figure 8B:
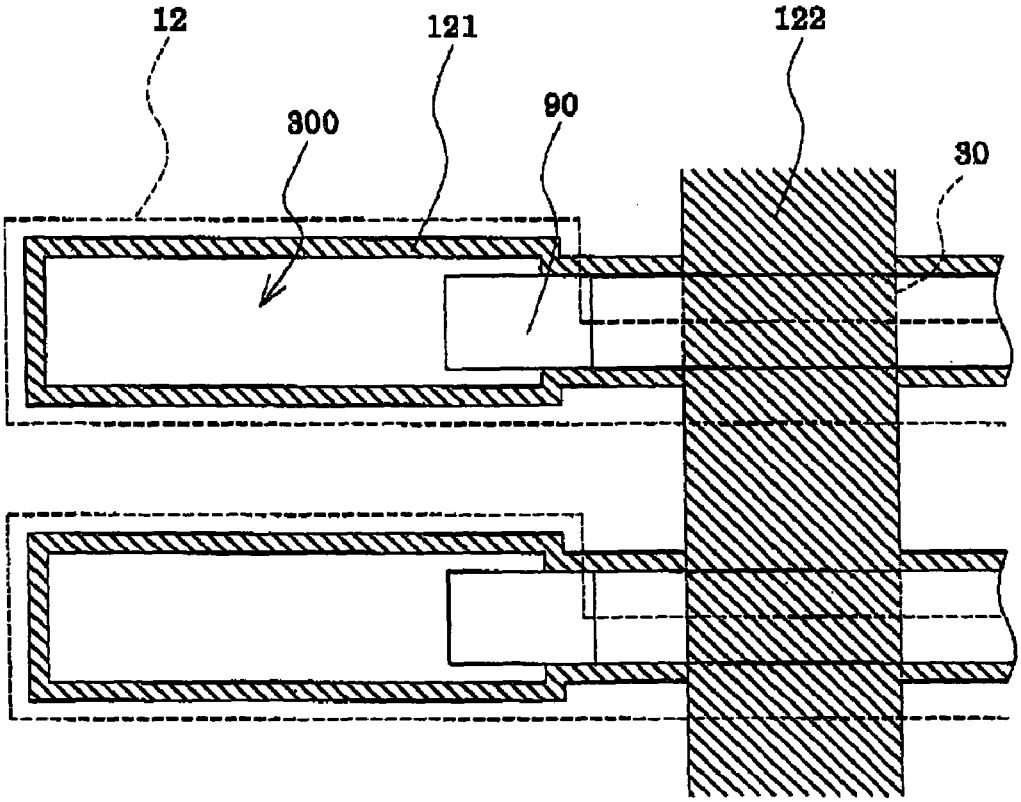
Figure 9:
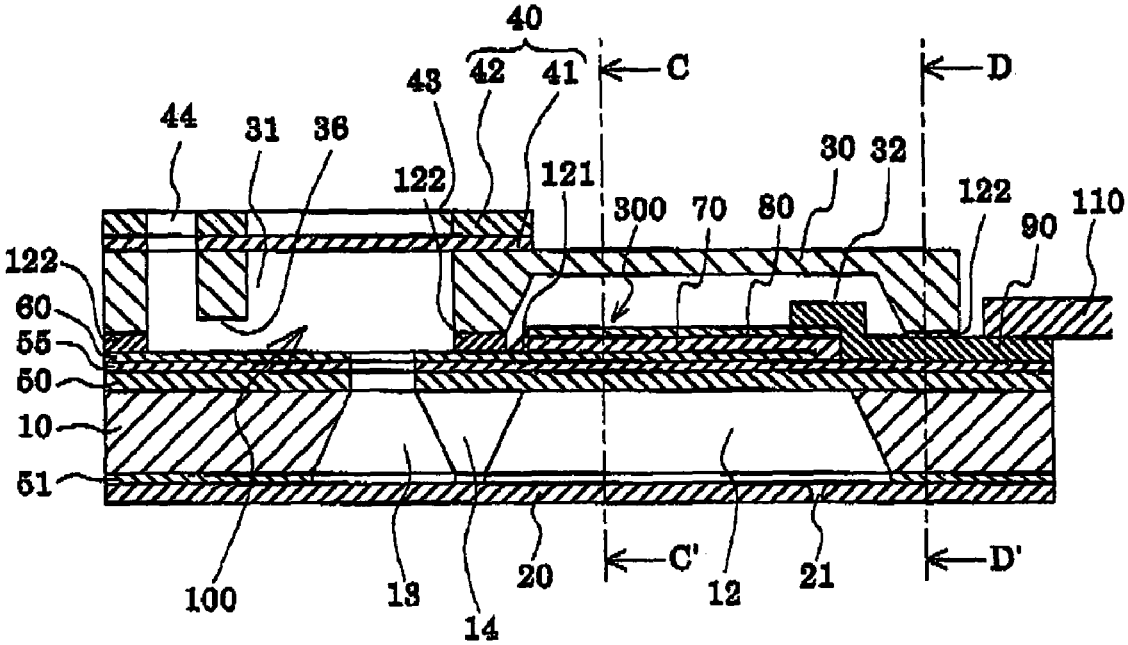
FIG. 9 is a cross-sectional view in a longitudinal direction of a piezoelectric element of the ink-jet recording head according to Embodiment 2 of the present invention.
Figure 10A:
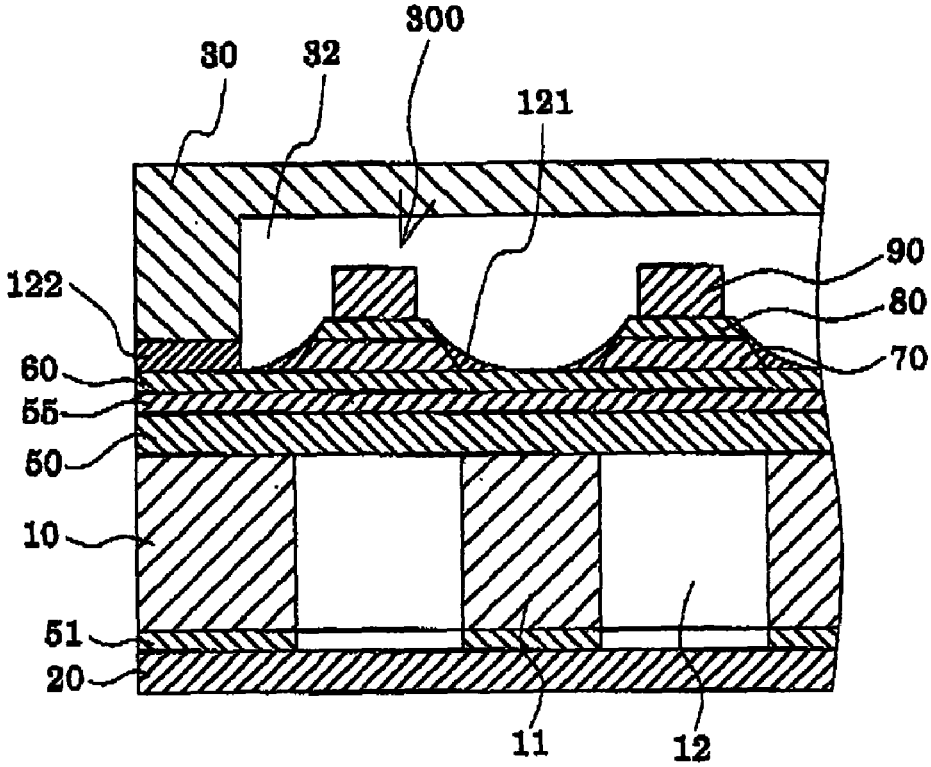
FIGS. 10A and 10B are cross-sectional views showing the ink-jet recording head according to Embodiment 2 of the present invention.
Figure 10B:
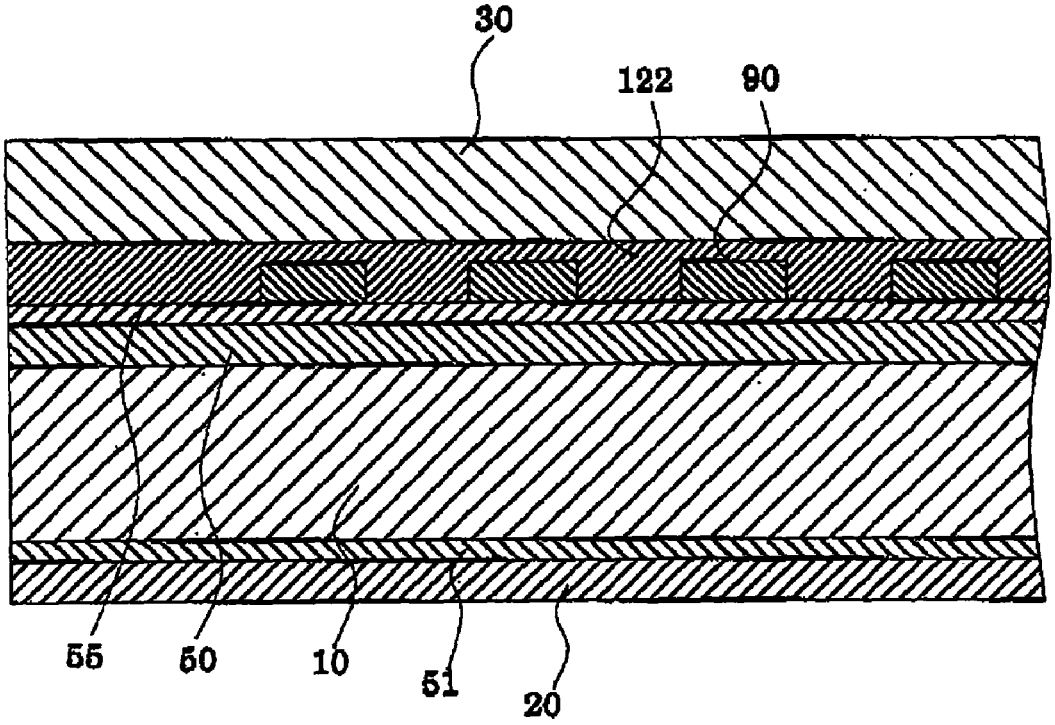

FIG. 7 is an exploded perspective view showing an ink-jet recording head according to Embodiment 2 of the present invention. FIG. 8A is a top plan view of the ink-jet recording head and FIG. 8B is a top plan view of a passage-forming substrate. FIG. 9 is a cross-sectional view in a longitudinal direction of a piezoelectric element of the ink-jet recording head. FIG. 10A is a cross-sectional view along the line C–C' in FIG. 9 and FIG. 10B is-a cross-sectional view along the line D–D' in FIG. 9. Note that the same parts as those of Embodiment 1 described above are denoted by the same reference numerals and repetitive description will be omitted.

As illustrated, on both sides of a passage-forming substrate 10 made of a single crystal silicon substrate are formed an elastic film 50, which is made of a thin film of 1 to 2 μm thick of silicon dioxide formed by thermal oxidation in advance, and a mask pattern 51 used as a mask in forming pressure generating chambers 12.

Moreover, on the outside in a longitudinal direction of the pressure generating chambers 12 in the passage-forming substrate 10, there are formed communicating portions 13, which communicate with a reservoir portion 31 provided in a reservoir forming plate 30 that is a junction plate and constitute a reservoir 100 forming a common ink chamber to each of the pressure generating chambers 12. Moreover, each of the communicating portions 13 is made to communicate via an ink supply path 14A with one end in the longitudinal direction of each pressure generating chamber 12. The ink supply path 14A communicates with the one end side in the longitudinal direction of the pressure generating chamber and has a cross-sectional area smaller than that of the pressure generating chamber 12. In this embodiment, the ink supply path 14A is formed to have a width smaller than that of the pressure generating chamber 12 by narrowing down a passage at the pressure generating chamber 12 side between the reservoir 100 and each pressure generating chamber in a width direction. Note that, as described above, in this embodiment, the ink supply path 14A is formed by narrowing down the width of the passage from one side. However, the ink supply path may be formed by narrowing down the width of the passage from both sides.

Moreover, on the opposite side to the opening surface of the passage-forming substrate 10, a piezoelectric element 300 including a lower electrode film 60, a piezoelectric layer 70 and an upper electrode film 80 is formed on an elastic film 50 having a thickness of, for example, about 1.0 μm with an insulating film 55 having a thickness of, for example, about 0.4 μm interposed therebetween. Moreover, between the piezoelectric element 300 and an external wiring 110, a lead electrode 90 is provided, which is a draw-out wiring drawn out from the piezoelectric element 300 to the external wiring 110.

Moreover, on the side of the piezoelectric element 300, an adhesion layer 121 covering the piezoelectric layer 70 so as not to expose at least the piezoelectric layer 70 is provided. In this embodiment, the adhesion layer 121 is provided so as to also cover the side face of the upper electrode film 80. To be more specific, in this embodiment, the adhesion layer 121 is provided over a square portion defined by a boundary between the side faces of the piezoelectric layer 70 and the upper electrode film 80 and the side face of the insulating film 55. The side face of the piezoelectric element 300 is covered with the adhesion layer 121 over its entire circumference except for the one end thereof in the longitudinal direction in which the lead electrode 90 is provided.

On the passage-forming substrate 10 where the piezoelectric element 300 described above is formed, that is, on the lower electrode film 60, the insulating film 55 and the lead electrode 90, the reservoir forming plate 30 having the reservoir portion 31 constituting the reservoir 100 and a piezoelectric element holding portion 32 is joined as the junction plate of this embodiment with a junction layer 122 interposed therebetween, which is formed of an adhesive agent, as shown in FIG. 9.

As described above, in the reservoir forming plate 30, the piezoelectric element holding portion 32 is provided in a region facing the piezoelectric element 300 on the passage-forming substrate 10. Thus, a region not facing the piezoelectric element 300, that is, a region not facing the pressure generating chamber 12 becomes an adhesion surface to be attached to the passage-forming substrate 10. In a part of a region on which the adhesion surface is allowed to abut, a plurality of the lead electrodes 90 are provided in parallel as the draw-out wirings drawn out from the piezoelectric element 300 as described above. Thus, on the adhesion surface of the reservoir forming plate 30, there exists an adhesion region allowed to abut on the lead electrodes 90 while intersecting with and straddling the lead electrodes 90. Since the adhesive agent exists so as to straddle the lead electrodes 90, steps between the lead electrodes 90 can be hermetically sealed. Moreover, the surface of the adhesive agent covering the steps can be made even. Thus, the passage-forming substrate 10 and the reservoir forming plate 30 can be surely joined together.

When the adhesive agent is applied onto the adhesion surface of the reservoir forming plate 30 described above and the adhesion surface is allowed to abut on the lead electrodes 90, as shown in FIG. 8, the adhesive agent provided in the adhesion region is allowed by the surface tension to run along the side face of the lead electrode 90, that is, a square portion defined by a boundary between the lead electrode 90 and the insulating film 55 and covers the side face of the piezoelectric element 300. Thus, on the side face of the piezoelectric element 300, the adhesion layer 121 is formed by use of the adhesive agent used in joining the reservoir forming plate 30 and the passage forming substrate 10.

As described above, in the junction between the reservoir forming plate 30 and the passage forming substrate 10 by use of the thermosetting adhesive agent, for example, when the adhesive agent is heated while the passage-forming substrate 10 and the reservoir forming plate 30 are made to abut against each other in a state where the adhesive agent is applied thereon, viscosity of the adhesive agent is temporarily lowered. Then, by the surface tension thereof, the adhesive agent covers the side face of the piezoelectric element 300 while running along the square portion defined by the boundary between the side face of the lead electrode 90 and the insulating film 55 on the passage-forming substrate 10. Thereafter, the adhesive agent is cured. By heating the adhesive agent as described above, the adhesion layer 121 can be formed on the side face of the piezoelectric element 300, and the passage-forming substrate 10 and the reservoir forming plate 30 can be joined together by interposing the junction layer 122 therebetween. Note that, as shown in FIG. 10B, the junction layer 122 which joins the passage-forming substrate 10 and the reservoir forming plate 30 together as described above is provided continuously across a direction, in which the lead electrodes 90 are provided in parallel, in the adhesion region of the reservoir forming plate 30, that is, between the insulating film 55 and the lead electrodes 90 on the passage-forming substrate 10 and the reservoir forming plate 30. Moreover, since the junction layer 122 is continuously provided also on the adhesion surface other than the adhesion region of the reservoir forming plate 30, the piezoelectric element holding portion 32 is hermetically sealed.

With reference to FIGS. 11 to 13, description will be given of a method of manufacturing the ink-jet recording head of this embodiment described above. FIGS. 11 to 13 are cross-sectional views illustrating a part of the pressure generating chamber of the ink-jet recording head in the longitudinal direction. First, as shown in FIG. 11A, a wafer of a single crystal silicon substrate to be the passage-forming substrate 10 is thermally oxidized in a diffusion furnace at about 1100° C. Accordingly, the elastic film 50 made of silicon dioxide is formed on the entire surface. Thereafter, as shown in FIG. 11, the insulating film 55 made of zirconium oxide or the like is formed on the elastic film 50.

Figure 11A:
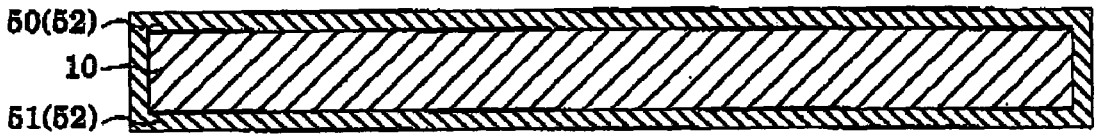
FIGS. 11A to 11D are cross-sectional views in a longitudinal direction of a pressure generating chamber, showing steps of manufacturing the ink-jet recording head according to Embodiment 2 of the present invention.
Figure 11B:
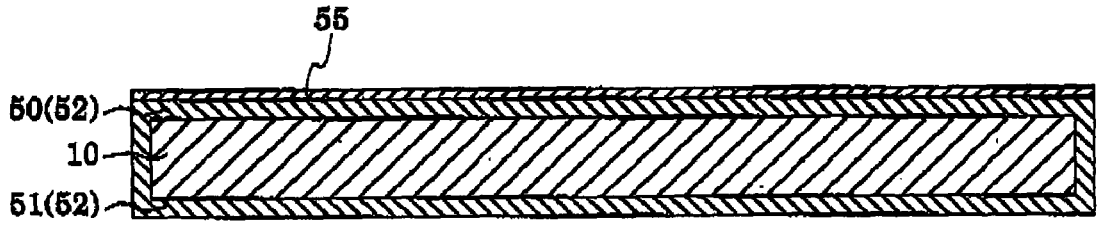
Figure 11C:
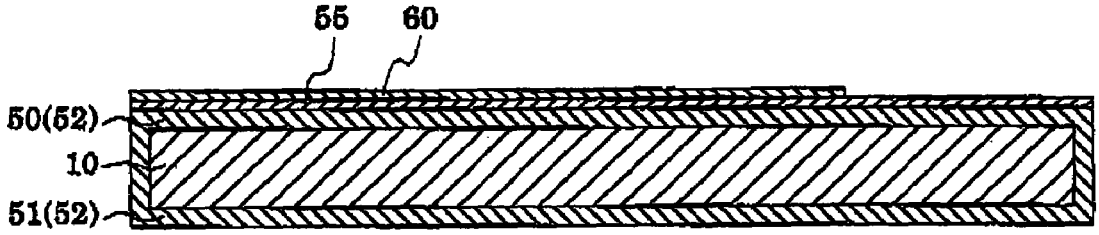
Figure 11D:
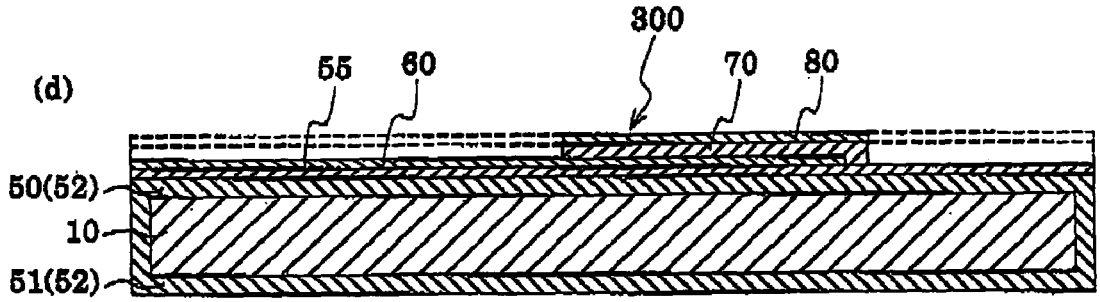

Next, as shown in FIG. 11C, after the lower electrode film 60 made of platinum and iridium, for example, is formed on the entire surface of the insulating film 55, patterning is performed in a predetermined shape. Subsequently, as shown in FIG. 11D, the piezoelectric layer 70 made of, for example, lead zirconate titanate (PZT) and the upper electrode film 80 made of, for example, iridium are sequentially laminated and are simultaneously subjected to patterning to form the piezoelectric element 300.

Figure 12A:
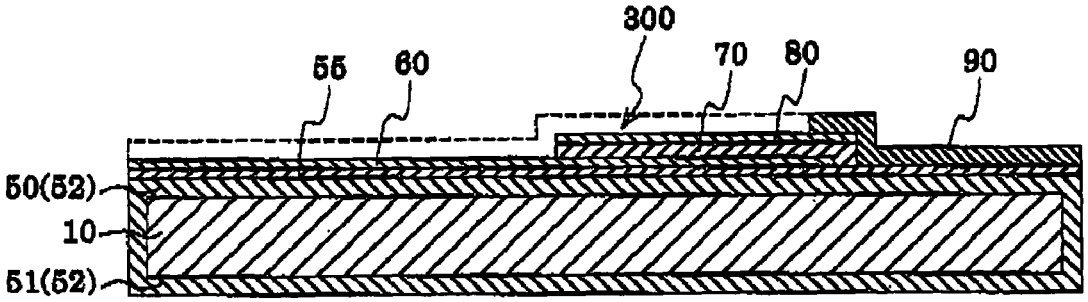
FIGS. 12A to 12D are cross-sectional views in the longitudinal direction of the pressure generating chamber, showing the steps of manufacturing the ink-jet recording head according to Embodiment 2 of the present invention.

Thereafter, as shown in FIG. 12A, the lead electrode 90 is formed. Specifically, the lead electrode 90 made of, for example, gold (Au) and the like is formed over the entire surface of the passage-forming substrate 10. At the same time, patterning of the lead electrode 90 is performed for each piezoelectric element 300. The above-described steps are the film formation process. After performing the film formation as described above, the passage-forming substrate 10 and the reservoir forming plate 30 are joined together by the junction layer 122. At the same time, the adhesion layer 121 is formed on the side faces of the piezoelectric layer 70 and upper electrode film 80.

Figure 12B:
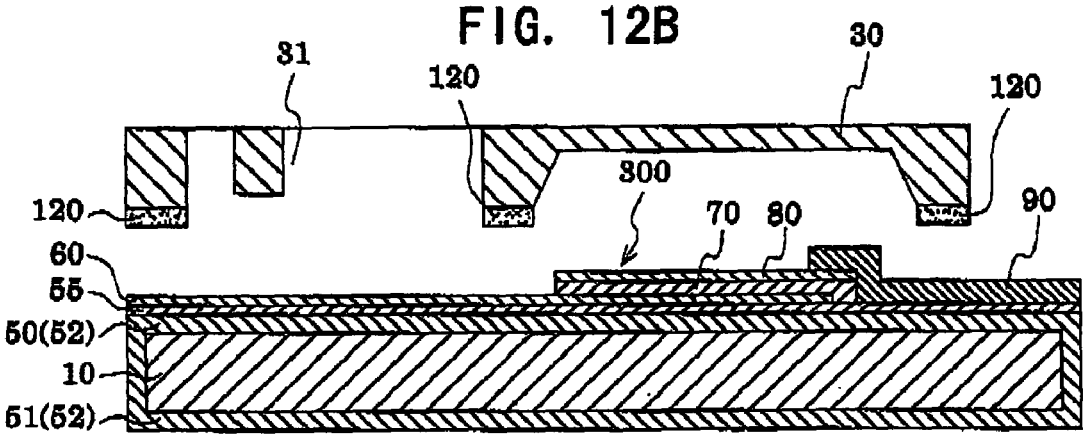

To be more specific, first, as shown in FIG. 12B, the adhesive agent 120 is applied to the adhesion surface of the reservoir forming plate 30 in which the piezoelectric element holding portion 32, the reservoir portion 31 and the like are previously formed. Note that, as the adhesive agent 120 applied to the adhesion surface, an epoxy thermosetting adhesive agent which is excellent in ink resistance and seal resistance and is capable of low-temperature adhesion can be cited. It is preferable that viscosity of such an epoxy adhesive agent before curing thereof is about 25±10 Pa·s at 25° C. This is in order for the adhesive agent 120 to completely cover the side face of the piezoelectric element 300 and not to flow out to an extra region when the side face of the piezoelectric element 300 is covered with the adhesive agent 120 by heating the adhesive agent 120 in a subsequent step. Moreover, it is preferable that the adhesive agent 120 applied to the adhesion surface of the reservoir forming plate 30 has a uniform film thickness. As the thickness of the adhesive agent 120 in the case where the viscosity thereof is 25±10 Pa·s at 25° C., about 1.0 to 5.0 μm is preferable. As a method of applying the adhesive agent 120 as described above, for example, film transfer capable of forming a uniform film thickness can be cited.

Figure 12C:
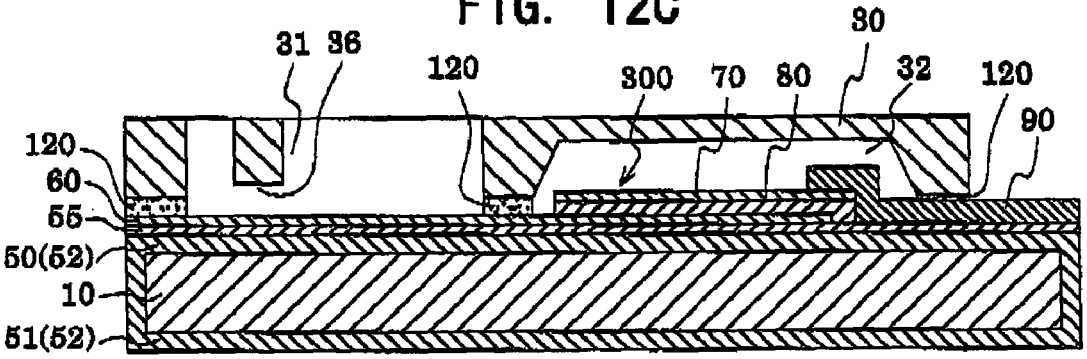

Next, as shown in FIG. 12C, the reservoir forming plate 30 is made to abut on the passage-forming substrate 10 with the adhesive agent 120 interposed therebetween. In this event, if the viscosity of the adhesive agent 120 before curing thereof, which is applied to the adhesion surface of the reservoir forming plate 30, is 25±10 Pa·s at 25° C., it is preferable that a pressure to allow the reservoir forming plate 30 to abut on the passage-forming substrate 10 is set to, for example, about 0.1 to 1.0 MPa. This is in order to surely join the passage-forming substrate 10 and the reservoir forming plate 30 together while allowing the adhesive agent 120 to completely cover the side face of the piezoelectric element 300 and not to flow out to an extra region in heating the adhesive agent 120 and covering the side face of the piezoelectric element 300 therewith in the subsequent step.

Figure 12D:
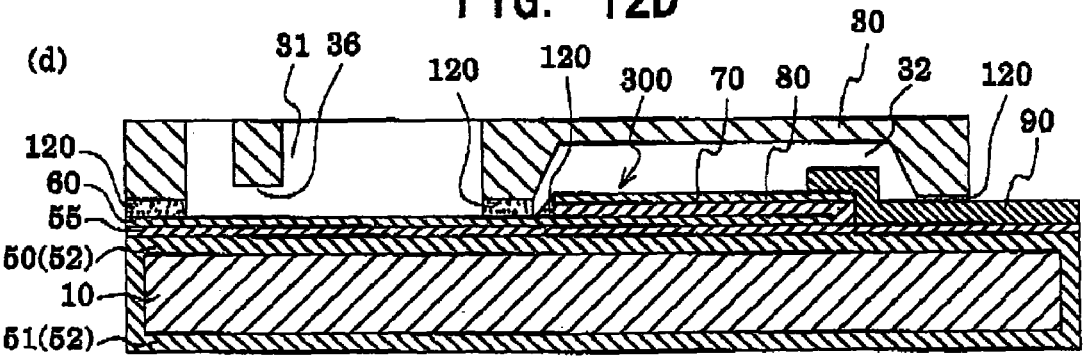

Next, the adhesion layer 121 is formed on the side face of the piezoelectric element 300 by heating the adhesive agent 120. At the same time, the passage-forming substrate 10 and the reservoir forming plate 30 are joined together with the junction layer 122 interposed therebetween. In this embodiment, for example, by performing preliminary heating, in which the adhesive agent is heated at 65° C. for 5 hours, as shown in FIG. 12D, the viscosity of the adhesive agent 120 is gradually lowered to allow the adhesive agent 120 to flow. In addition, by the surface tension thereof, the adhesive agent 120 is allowed to run around the square portion defined by the insulating film 55 and the lead electrode 90 on the passage-forming substrate 10. Thus, the adhesive agent 120 running around the square portion covers the square portion defined by the side faces of the piezoelectric layer 70 and upper electrode film 80 and the boundary between the lower electrode film 60 and the insulating film 55.

Note that, since the adhesive agent 120 used in this embodiment has a glass transition point of 79° C., for example, when the adhesive agent is subjected to the preliminary heating at 79° C. of the glass transition point or more, the viscosity thereof is drastically lowered and the adhesive agent 120 is more likely to run around the square portion. Consequently, there is a risk that the adhesive agent 120 covers even the upper surface of the upper electrode film 80. Moreover, to the contrary, when the temperature of the preliminary heating is too low, no adhesive agent 120 runs around the square portion. Thus, the entire side face of the piezoelectric layer 70 cannot be covered. Consequently, it is preferable that the temperature at which the adhesive agent 120 of this embodiment is subjected to the preliminary heating is 45° C. to 78° C. in consideration of the adhesive agent 120 running around the square portion.

Figure 13A:
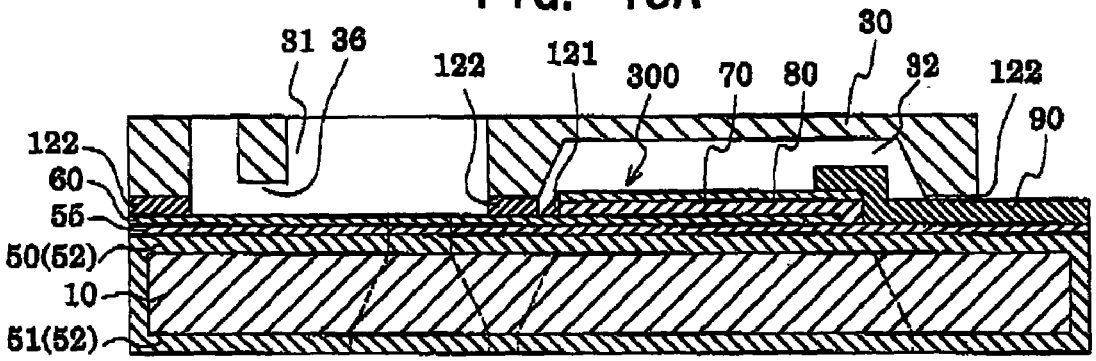
FIGS. 13A to 13C are cross-sectional views in the longitudinal direction of the pressure generating chamber, showing the steps of manufacturing the ink-jet recording head according to Embodiment 2 of the present invention.

Next, as shown in FIG. 13A, by performing cure heating after the preliminary heating, in which the adhesive agent 120 is heated for 8 hours at, for example, 140° C. which is higher than the temperature of the preliminary heating, the adhesive agent 120 is cured. Accordingly, the junction layer 122, which joins the passage-forming substrate 10 and the reservoir forming plate 30 together, and the adhesion layer 121, which prevents damage to the piezoelectric element 300 attributable to the external environment, are simultaneously formed by use of the same adhesive agent 120.

Note that a heat resistant temperature of the adhesive agent 120 of this embodiment is 150° C. At the same time, the passage-forming substrate 10 having the reservoir forming plate 30 joined thereon is heated at about 100° C. in preparations and the like such as when resist is formed, which is used for protecting other portions in forming the pressure generating chambers 12 by etching in a subsequent step and when a nozzle plate 20 and a compliance plate 40 are joined together on the passage-forming substrate 10. Thus, the temperature of the cure heating is preferably 100° C. to 150° C., more preferably 140° C.

As described above, in joining the passage-forming substrate 10 and the reservoir forming plate 30 together with the adhesive agent 120 interposed therebetween, the heating is performed at the two stages including the preliminary heating and the cure heating. Thus, complete curing can be performed by allowing the adhesive agent 120 to surely run around the side face of the piezoelectric element 300. Moreover, in the cure heating, the adhesive agent is heated at the temperature of heating in a subsequent step or more and cured. Thus, deformations due to heat generated by the heating in the subsequent step can be reduced.

Furthermore, the adhesion layer 121 is formed on the side face of the piezoelectric element 300 by use of the adhesive agent 120 used in joining the passage-forming substrate 10 and the reservoir forming plate 30 together. Thus, it is possible to easily and surely cover only the side face of the piezoelectric element 300 with the adhesion layer 121. In addition, the manufacturing process thereof can be simplified and the manufacturing costs can be reduced. Moreover, by use of the adhesive agent 120 which joins the passage-forming substrate 10 and the reservoir forming plate 30 together, damage to the piezoelectric element 300 attributable to the external environment is prevented and the adhesion layer 121 which improves the withstand voltage of the piezoelectric element 300 is formed. Thus, a hermetical sealing step of hermetically sealing the piezoelectric element holding portion 32 is not required. Consequently, the manufacturing process can be simplified.

Figure 13B:
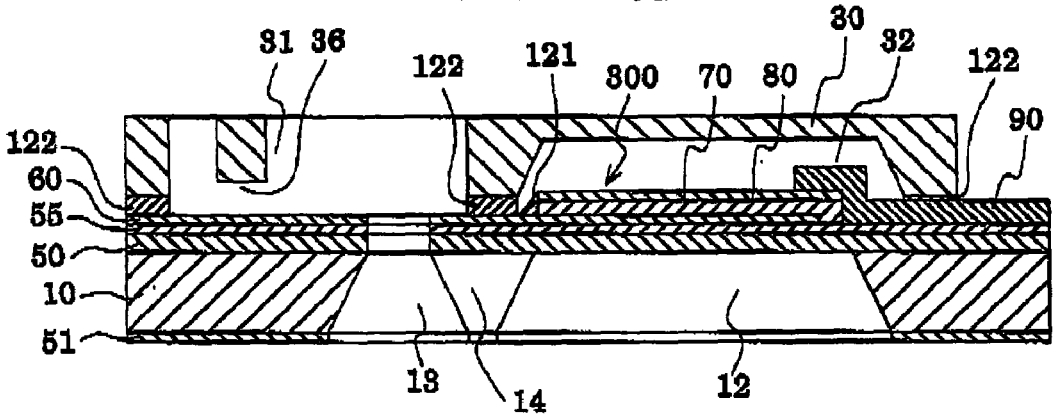
Figure 13C:
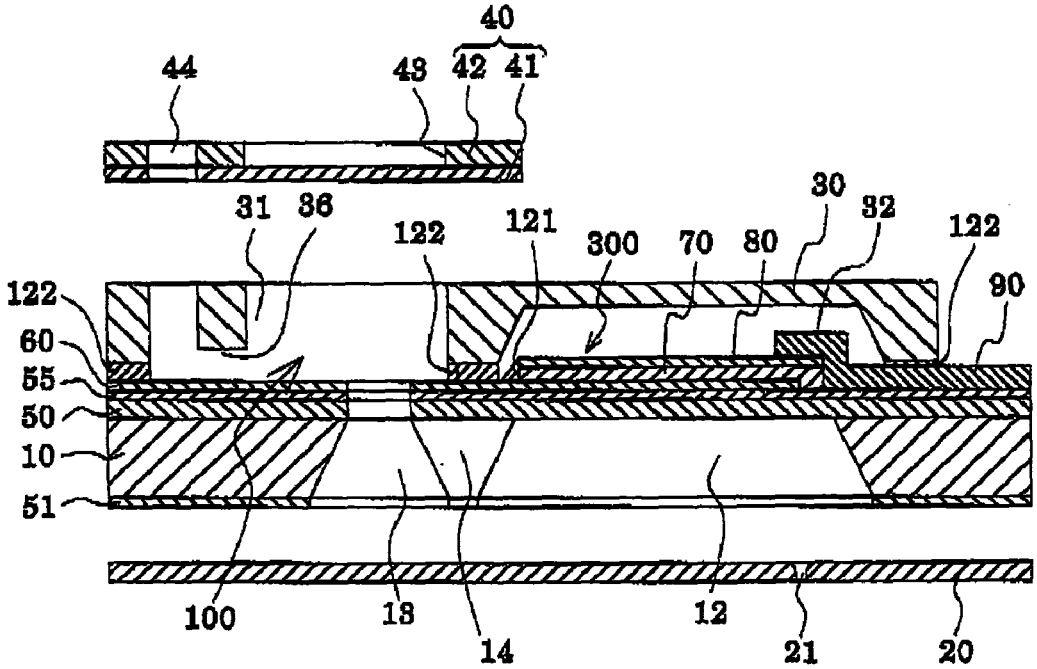

Next, as shown in FIG. 13B, anisotropic etching is performed for the single crystal silicon substrate by use of the alkaline solution described above. Accordingly, the pressure generating chamber 12, the communicating portion 13, the ink supply path 14A and the like are formed. Thereafter, as shown in FIG. 13C, the nozzle plate 20 with nozzle orifices 21 drilled therein is joined onto the opposite side of the passage-forming substrate 10 to the reservoir forming plate 30. At the same time, the compliance plate 40 is joined onto the reservoir forming plate 30. Thus, the ink-jet recording head of this embodiment is formed.

Moreover, practically, a number of chips are simultaneously fabricated on one wafer by a series of the above-described film formation and anisotropic etching. Then, after the process is finished, the wafer is divided into passage-forming substrates 10 of one chip size as shown in FIG. 7. Thereafter, the reservoir forming plate 30 and the compliance plate 40 are sequentially adhered onto the divided passage-forming substrate 10 to be unified. Thus, the ink-jet recording head is obtained.

(Other Embodiment)

Although Embodiment 1 and 2 of the present invention has been described above, needless to say, the present invention is not limited to the above-described one.

Figure 14:
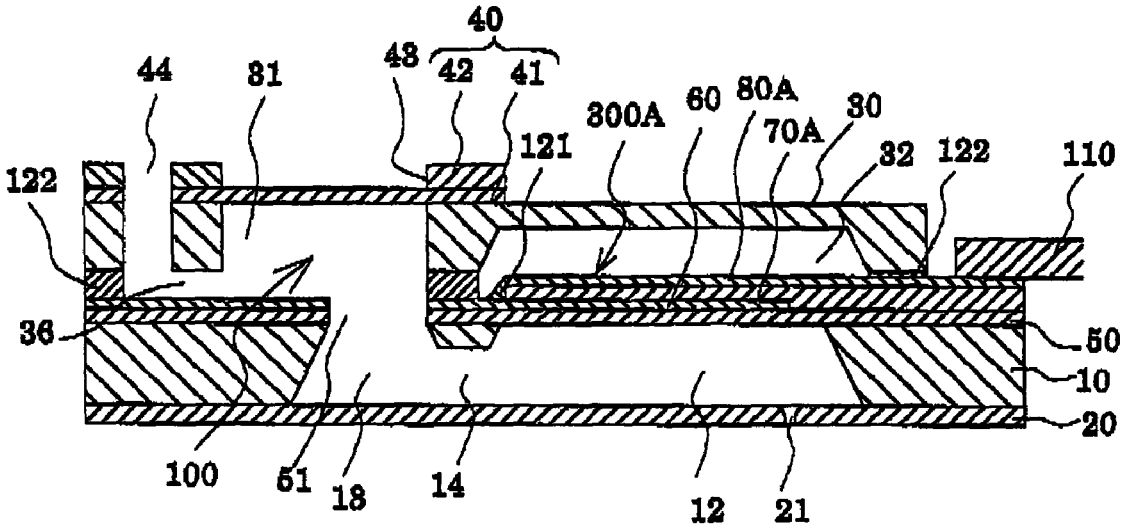
FIG. 14 is a cross-sectional view in a longitudinal direction of a pressure generating chamber, showing an ink-jet recording head according to another embodiment of the present invention.

For example, in the above-described Embodiment 1 and 2, the draw-out wiring electrically connecting the piezoelectric element 300 with the external wiring 110 is set as the lead electrode 90 extended from the vicinity of the one end in the longitudinal direction of the upper electrode film 80 to the vicinity of the one end-of the passage-forming substrate 10, and the reservoir forming plate 30 is joined onto the lead electrodes 90 provided in parallel. However, the draw-out wiring electrically connecting the external wiring 110 with the piezoelectric element 300 is not particularly limited to the above. For example, the piezoelectric layer of the piezoelectric element and the upper electrode film are extended to the vicinity of the end portion of the passage-forming substrate, and thus a part of the extended piezoelectric element can be set as the draw-out wiring. Herein, such an example is shown in FIG. 14. Note that FIG. 14 is a cross-sectional view of Embodiment 1 of a pressure generating chamber in its longitudinal direction, showing another example of an ink-jet recording head.

As shown in FIG. 14, on the elastic film 50 on the passage-forming substrate 10, a piezoelectric layer 70A and an upper electrode film 80A are extended to the vicinity of the end portion of the passage-forming substrate 10, thus constituting a piezoelectric element 300A.

To the upper electrode film 80A thus extended, the external wiring 110 is electrically connected directly. Furthermore, the reservoir forming plate 30 is joined onto a region of the upper electrode film 80A, which is provided between a piezoelectric active portion in a region of the piezoelectric element 300A corresponding to the area of the pressure generating chamber 12 and the extended end portion connected to the external wiring 110.

Specifically, the piezoelectric layer 70A and the upper electrode film 80A of the piezoelectric element 300, which are extended to the vicinity of the end portion of the passage-forming substrate 10, form the draw-out wiring of the piezoelectric element 300.

On the side of the piezoelectric element 300, the adhesion layer 121 covering the piezoelectric element so as not to expose at least the piezoelectric layer 70A is formed.

In joining the passage-forming substrate 10 and the reservoir forming plate 30 together, this adhesion layer 121 can be formed along the side face of the extended piezoelectric element 300 where the adhesive agent is sandwiched between the passage-forming substrate 10 and the reservoir forming plate 30.

According to the ink-jet recording head with such a constitution, an effect similar to that of the above-described Embodiment 1 and 2 can be obtained.

Furthermore, the reservoir forming plate 30 was exemplified as an junction plate joined onto the passage-forming substrate 10 in the above-described Embodiment 1 and 2. However, as long as the junction plate is one which is joined onto the draw-out wiring of the piezoelectric element on the passage-forming substrate via the adhesive agent, the junction plate is not particularly limited to the above.

Moreover, for example, in the above-described Embodiment 1 and 2, exemplified is a thin-film type ink-jet recording head, which is manufactured by adopting deposition and a lithography process. However, needless to say, the present invention is not limited to the above example. For example, the present invention can be employed in a thick-film type ink-jet recording head, which is formed by a method of attaching a green sheet and the like.

Furthermore, in the above-described Embodiment 1 and 2, in joining the passage-forming substrate 10 and the reservoir forming plate 30 together, although the piezoelectric element holding portion 32 is hermetically sealed simultaneously, this process of hermetically sealing can be performed later. With such a constitution, more secure sealing is made possible.

Figure 15:
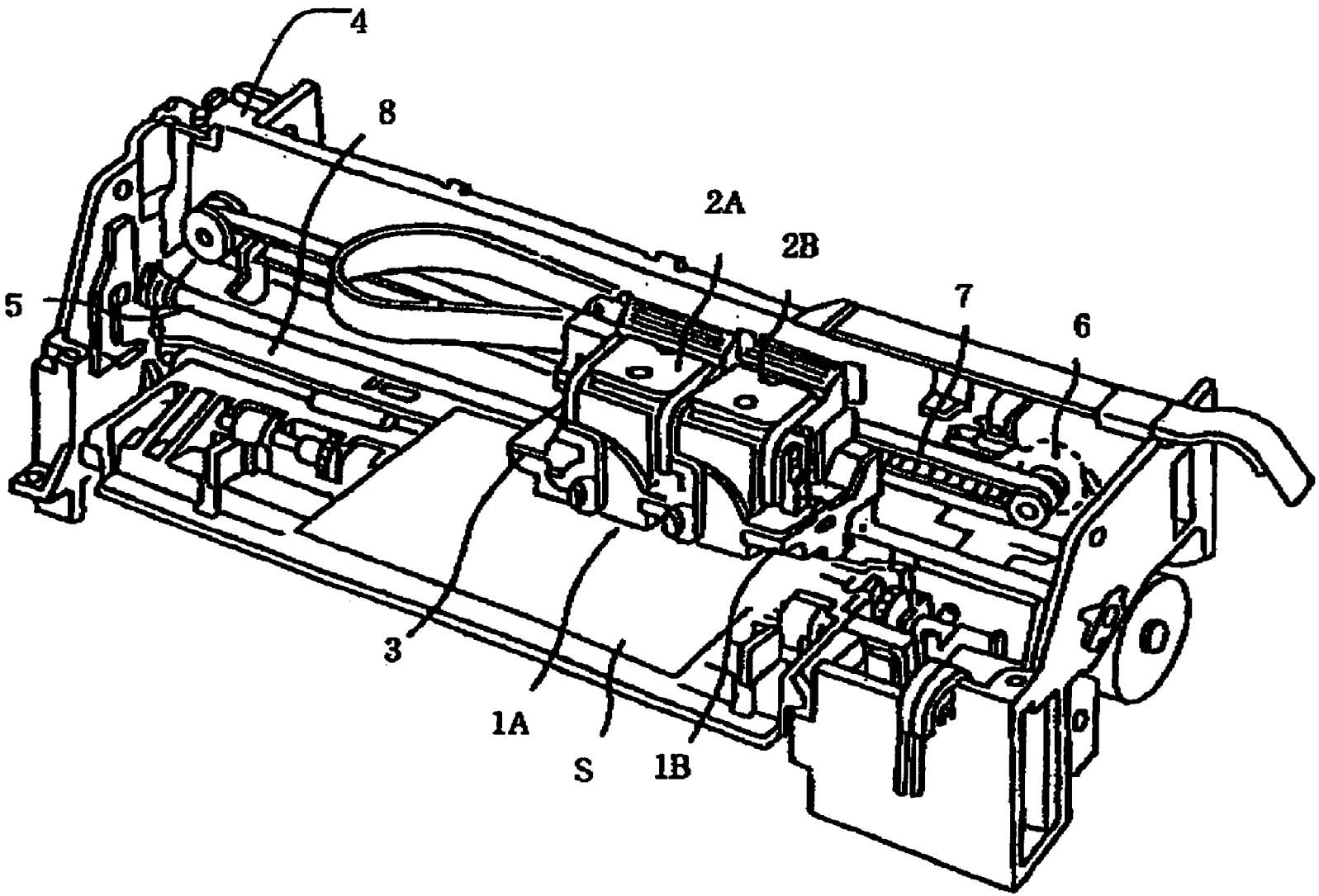
FIG. 15 is a schematic perspective view of an ink-jet recording apparatus according to an embodiment of the present invention.

The ink-jet recording head of each embodiment described above constitutes a part of a recording head unit, which includes an ink flow path communicating with an ink cartridge and the like, and is mounted on an ink-jet recording apparatus. FIG. 15 is a schematic view showing an example of the ink-jet recording apparatus.

As shown in FIG. 15, in recording head units 1A and 1B having ink-jet recording heads, cartridges 2A and 2B constituting ink supply means are provided detachably. A carriage 3 on which the recording head units 1A and 1B are mounted is provided on a carriage axis 5 fixed to an apparatus body 4, the carriage 3 being provided movably in an axis direction. The recording head units 1A and 1B are intended to eject, for example, a black-ink composition and a color-ink composition, respectively.

A driving force of a drive motor 6 is transmitted to the carriage 3 via a plurality of gears, which is not shown, and a timing belt 7. Accordingly, the carriage 3, on which the recording head units 1A and 1B are mounted, is moved along the carriage axis 5. Meanwhile, a platen 8 is provided along the carriage axis 5 in the apparatus body 4 and a recording sheet S is conveyed on the platen 8, the recording sheet being a recording medium such as paper fed by an unillustrated paper feed roller and the like.

In the above-described Embodiment 1 and 2, as a liquid-jet head, an ink-jet recording head for printing a predetermined image and letter on a printing medium has been described as an example. However, needless to say, the present invention is not limited to the above, but is applicable to other liquid-jet heads. As the liquid-jet head, enumerated, are, for example: a color material-jet head used in manufacturing a color filter for a liquid crystal display and the like; an electrode material-jet head used for forming electrode for an organic EL display, a FED (field emission display) and the like; a bio-organic jet head used in manufacturing a bio chip; and the like.

What is claimed is:

1. A liquid-jet head, comprising:

a passage-forming substrate in which a pressure generating chamber communicating with a nozzle orifice is defined; and a piezoelectric element which includes a lower electrode, a piezoelectric layer and an upper electrode and is provided on the passage-forming substrate with a vibration plate interposed therebetween, wherein the piezoelectric element is made of a thin film directly formed on the vibration plate without an adhesive agent interposed therebetween by deposition and a lithography method; on a surface of the passage-forming substrate, the surface facing the piezoelectric element, a junction plate is joined onto a draw-out wiring drawn out of the piezoelectric element with an insulating adhesive agent interposed therebetween; and only a side face of the piezoelectric element is covered with an adhesion layer made of an adhesive agent joining the junction plate so as not to expose at least the piezoelectric layer.

2. The liquid-jet head according to claim 1, wherein the adhesion layer is formed by the surface tension thereof in a square portion defined by a boundary between the side face of the piezoelectric element and the vibration plate.

3. The liquid-jet head according to claim 1, wherein the adhesion layer is also provided on a side face of the upper electrode.

4. The liquid-jet head according to claim 1, wherein a gas permeability of the adhesive agent is $1\times10^{-3}$Pa·m$^3$/sec or less.

5. The liquid-jet head according to claim 1, wherein the adhesive agent is a thermosetting adhesive agent.

6. The liquid-jet head according to claim 1, wherein the draw-out wiring is made of a part of the piezoelectric element.

7. The liquid-jet head according to claim 1, wherein the draw-out wiring is a lead electrode extended from the upper electrode to the passage-forming substrate.

8. The liquid-jet head according to claim 1, wherein the vibration plate is directly formed on the passage-forming substrate without an adhesive agent interposed therebetween.

9. The liquid-jet head according to claim 1, wherein the vibration plate includes the lower electrode.

10. The liquid-jet head according to claim 1, wherein the pressure generating chamber is formed on a single crystal silicon substrate by anisotropic etching.

11. The liquid-jet head according to claim 1, wherein a plurality of the draw-out wirings are provided in parallel and extended to a region not facing the pressure generating chambers on the passage-forming substrate and each of the draw-out wirings has a side face continuing to a side face of the piezoelectric element, the liquid-jet head further comprising an adhesion region where the junction plate is joined while intersecting with and straddling at least a part of the plurality of draw-out wirings provided in parallel.

12. The liquid-jet head according to claim 1, wherein a side face of the draw-out wiring is covered with the adhesion layer.

13. A liquid-jet apparatus comprising the liquid-jet head according to any one of claims 1 to 12.

14. A method of manufacturing a liquid-jet head including: a passage-forming substrate in which a pressure generating chamber communicating with a nozzle orifice ejecting a liquid droplet is defined; a piezoelectric element which includes a lower electrode, a piezoelectric layer and an upper electrode and a thin film formed on a vibration plate provided on one face of the passage-forming substrate by deposition and a lithography method without an adhesive agent interposed therebetween; and a junction plate joined onto a surface of the passage-forming substrate, the surface facing the piezoelectric element, the method comprising the steps of: allowing the junction plate to abut on the passage-forming substrate and on a draw-out wiring drawn out of the piezoelectric element with an adhesive agent interposed therebetween; covering the side face of the piezoelectric element with the adhesive agent not to expose at least the piezoelectric layer by allowing the adhesive agent to run along a side face of the draw-out wiring by a surface tension of the adhesive agent; and joining the passage-forming substrate and the junction plate.

15. The method of manufacturing a liquid-jet head according to claim 14, wherein the adhesive agent is a thermosetting adhesive agent.

16. The method of manufacturing a liquid-jet head according to claim 15, wherein, by heating and curing the adhesive agent, the adhesive agent is allowed to run along the side face of the draw-out wiring, thus covering the piezoelectric layer.

17. The method of manufacturing a liquid-jet head according to claim 16, wherein a heating step of curing the adhesive agent includes a preliminary heating step of heating the adhesive agent at a temperature lower than a temperature at which viscosity of the adhesive agent in its viscosity-temperature properties becomes minimum and covering at least a side face of the piezoelectric layer with the adhesive agent and a cure heating step of heating at a temperature to cure the adhesive agent applied in the preliminary heating step.

18. The method of manufacturing a liquid-jet head according to claim 14, wherein viscosity of the adhesive agent before curing thereof is 25±10 Pa·s at 25° C.

19. The method of manufacturing a liquid-jet head according to claim 18, wherein a thickness of the adhesive agent before the passage-forming substrate and the junction plate are joined together is 1.0 to 5.0 μm.

20. The method of manufacturing a liquid-jet head according to any one of claims 18 and 19, wherein the adhesive agent is pressurized at a pressure of 0.1 to 1.0 MPa in allowing the junction plate to abut on the passage-forming substrate.

* * * * *